US009085379B2

(12) United States Patent
Cummins

(10) Patent No.: US 9,085,379 B2
(45) Date of Patent: Jul. 21, 2015

(54) CONTAINER DRIP DRAINING DEVICE

(71) Applicant: Lane Alan Cummins, Austin, TX (US)

(72) Inventor: Lane Alan Cummins, Austin, TX (US)

( * ) Notice: Subject to any disclaimer, the term of this patent is extended or adjusted under 35 U.S.C. 154(b) by 330 days.

(21) Appl. No.: 13/782,365

(22) Filed: Mar. 1, 2013

(65) Prior Publication Data

US 2014/0246123 A1 Sep. 4, 2014

(51) Int. Cl.

| | |
|---|---|
| ***B65B 3/06*** | (2006.01) |
| ***B67C 9/00*** | (2006.01) |
| ***A47L 13/00*** | (2006.01) |

(52) U.S. Cl.

CPC . *B65B 3/06* (2013.01); *A47L 13/00* (2013.01); *B67C 9/00* (2013.01)

(58) Field of Classification Search

CPC ..... B65B 3/06; B65B 1/06; B67D 3/008; B67D 3/0083; B67C 9/00

USPC ..... 141/363–364, 86, 319, 369, 375, 391; 248/213.2, 311.3; 211/85; 220/735; 222/181.1, 181.3, 166

See application file for complete search history.

(56) References Cited

U.S. PATENT DOCUMENTS

| | | | | |
|---|---|---|---|---|
| 496,537 | A * | 5/1893 | Purrington | 141/364 |
| 623,366 | A | 4/1899 | Halvorsen | |
| 1,788,262 | A * | 1/1931 | Wiebusch | 141/364 |
| 1,928,995 | A * | 10/1933 | De Biasi | 220/735 |
| 2,018,929 | A | 10/1935 | Anderson et al. | |
| 2,791,391 | A | 5/1957 | Uphoff et al. | |
| 2,861,764 | A | 11/1958 | Fisher et al. | |
| 2,864,509 | A | 12/1958 | Watral et al. | |
| 3,049,137 | A | 8/1962 | Cole et al. | |
| 3,217,891 | A | 11/1965 | Weaver et al. | |
| 3,995,544 | A | 12/1976 | Farley | |
| 4,022,257 | A | 5/1977 | O'Connell | |
| 4,040,964 | A | 8/1977 | Hegyi | |
| 4,098,398 | A | 7/1978 | Meyers | |
| D252,372 | S | 7/1979 | Macaulay | |
| D272,222 | S | 1/1984 | Cho | |
| 4,488,584 | A | 12/1984 | Hestehave et al. | |
| 4,640,431 | A | 2/1987 | Harrison | |
| 4,673,081 | A | 6/1987 | Habig et al. | |
| D290,673 | S | 7/1987 | Imatt | |
| 4,881,650 | A | 11/1989 | Bartz | |
| D310,170 | S | 8/1990 | Bartz | |
| 4,974,647 | A | 12/1990 | Eastom | |
| D331,791 | S | 12/1992 | Ferguson | |
| D332,551 | S | 1/1993 | Fields et al. | |
| 5,180,033 | A | 1/1993 | Wilson | |

(Continued)

*Primary Examiner* — Timothy L Maust
*Assistant Examiner* — Timothy P Kelly
(74) *Attorney, Agent, or Firm* — Sean Christian Connolly

(57) ABSTRACT

Disclosed herein is an apparatus for draining an open-top container into another open-top container by supporting an open-top container to be drained upon the lip of another open-top container, which receives the contents of the first open-top container. The Container Drip Draining Device supports the open-top container to be drained in a stable manner and at an angle sufficient to drip drain the first container into the second and comprises a singular construction with a means of attaching the device to the lip of a receiving open-top container, a means of supporting an open-top container in a pouring position over the receiving open-top container comprising a tongue-shaped extension with a lip support, a plurality of pegs distending from the tongue-shaped extension for hanging utensils, a post distending vertically from the tongue-shaped extension to allow for the drip draining of smaller containers and hooks for supporting a hanging strainer basket.

3 Claims, 31 Drawing Sheets

(56) References Cited

U.S. PATENT DOCUMENTS

| | | | | |
|---|---|---|---|---|
| D337,401 | S | 7/1993 | Maxwell | |
| 5,272,968 | A | 12/1993 | Keville et al. | |
| D343,767 | S | 2/1994 | Sambrookes et al. | |
| D351,394 | S | 10/1994 | Morris | |
| 5,615,798 | A | 4/1997 | Luburic et al. | |
| 5,706,721 | A | 1/1998 | Homes | |
| 5,794,671 | A | 8/1998 | Smith | |
| 5,902,481 | A | 5/1999 | Schwietert | |
| D418,150 | S | 12/1999 | Maynard | |
| 6,592,092 | B2 | 7/2003 | Stahlberg | |
| 6,684,922 | B1 | 2/2004 | Alston et al. | |
| D512,881 | S | 12/2005 | Bertulis et al. | |
| D520,367 | S | 5/2006 | Morris | |
| 7,090,087 | B1 | 8/2006 | Guralski | |
| 7,282,018 | B2 | 10/2007 | Priest, III | |
| D581,746 | S | 12/2008 | Holmes | |
| 7,490,798 | B2 | 2/2009 | Mann | |
| D640,512 | S | 6/2011 | Gorskey et al. | |
| 8,162,012 | B2 * | 4/2012 | Kulas | 141/365 |
| 8,820,572 | B2 * | 9/2014 | Miller | 220/737 |
| 2002/0066844 | A1 | 6/2002 | Kelly | |

* cited by examiner

CONTAINER DRIP DRAINING DEVICE

CROSS-REFERENCE TO RELATED APPLICATIONS

This application claims benefit of U.S. Provisional Patent Application No. 61/634,569 which was filed on Mar. 2, 2012, and which is incorporated herein in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention is in the technical field of container draining devices. More particularly, the preferred embodiments of the present invention relate generally to an apparatus for draining open-top containers, such as buckets, pails or the like, into another open-top container. More particularly, the preferred embodiments of the present invention relate generally to an apparatus, which supports an open-top container to be drained upon the lip of another open-top container, which receives the contents of the open-top container to be drained. More particularly, the preferred embodiments of the present invention relate generally to an apparatus, which supports an open-top container to be drained in a stable manner and at an angle sufficient to drip drain the first container into the second.

2. Description of the Related Art

The broad concept of using an apparatus for draining containers is known. These inventions usually involve using supporting a container in an upside-down fashion. However, these inventions do not allow for one container to be supported at an angle by another container.

It is also known to use an apparatus for supporting a container during draining However, these inventions do not use a receiving container to support the draining container.

It is also known to use an apparatus to support a container in an inverted manner in order to facilitate draining While these inventions usually provide a means of supporting an inverted container for draining, they do not provide for a means of receiving the material being drained from the inverted container.

It is also known to use an apparatus for supporting a container at an angle during draining However, these inventions are not supported by the container which receiving the material being drained.

It is also known to use an apparatus to strain a container during draining Usually these inventions involve receiving containers, which have integrated strainers.

It is also known to use an apparatus for supporting a container to be drained above another container. However, these inventions do not allow for the draining container to be supported at an angle and do not using the receiving container for stably supporting the draining container at an angle.

SUMMARY OF THE INVENTION

The broad embodiments of the present invention relates generally to an apparatus for draining open-top containers, such as buckets, pails or the like, into another open-top container by supporting the open-top container to be drained upon the lip of another open-top container, which receives the contents of the open-top container to be drained. The Container Drip Draining Device supports the open-top container to be drained in a stable manner and at an angle sufficient to drip drain the first container into the second.

In one preferred embodiments, the present invention relates to an apparatus for draining open-top containers into another open-top container, which comprises a singular construction with a means of attaching the device to the lip of a receiving open-top container, a means of supporting an open-top container in a pouring position over the receiving open-top container comprising a tongue-shaped extension with a lip support.

In another preferred embodiment, the present invention comprises a wireframe singular construction with a means of attaching the device to the lip of a receiving open-top container, a means of supporting an open-top container in a pouring position over the receiving open-top, and one or more hooks for supporting a hanging strainer basket, and is intended for supporting larger containers.

In the more preferred embodiments, the present invention relates to an apparatus for draining open-top containers into another open-top container, which comprises a singular construction with a means of attaching the device to the lip of a receiving open-top container, a means of supporting an open-top container in a pouring position over the receiving open-top container comprising a tongue-shaped extension with a lip support, a plurality of pegs distending from the tongue-shaped extension for hanging utensils or tools, such as paintbrushes, or the like, a pole or post distending vertically from the tongue-shaped extension to allow for the drip draining of jugs or bottles of different shapes and sizes and one or more hooks for supporting a hanging strainer basket. The Container Drip Draining Device provides a convenient way of draining containers without having to hold the draining container by hand.

In the most preferred embodiments, the present invention relates to an apparatus for draining open-top containers into another open-top container, which comprises a singular construction, which is cut out of a flat foldable material, such as cardboard or plastic, and which may be folded into a structure with slots for attaching the device to the lip of a receiving open-top container and slots and tabs, which support an open-top container in a pouring position over the receiving open-top container.

BRIEF DESCRIPTION OF THE DRAWING

Illustrative and preferred embodiments of the present invention are shown in the accompanying drawings in which.

DETAILED DESCRIPTION OF THE PREFERRED EMBODIMENTS

For the purpose of illustration, the present invention is shown in the preferred embodiments of an apparatus for draining open-top containers, such as buckets, pails or the like, into another open-top container by supporting an open-top container to be drained upon the lip of another open-top container for receiving the contents of the open-top container to be drained, a similar apparatus which includes pegs for suspending utensils, such as paint brushes, mixers, or the like, and hooks for suspending baskets, filters, screens, or the like, a wireframe version of the apparatus, and the most preferred embodiment, which is a flat foldable version of the apparatus. These embodiments are not intended to limit the scope of the present invention.

Figure 1:
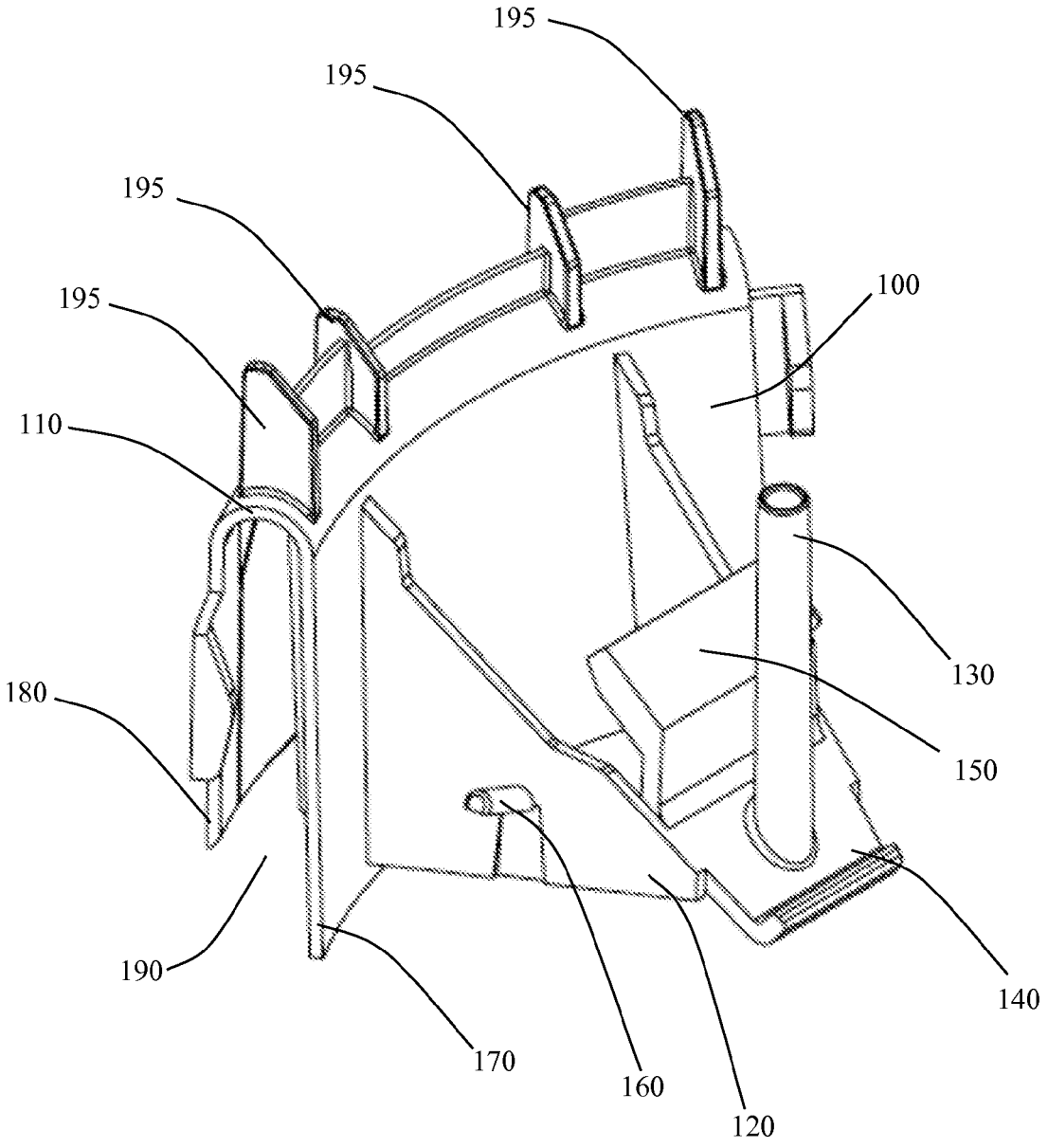
FIG. 1 is a front perspective view of an apparatus of the present invention.
Figure 2:
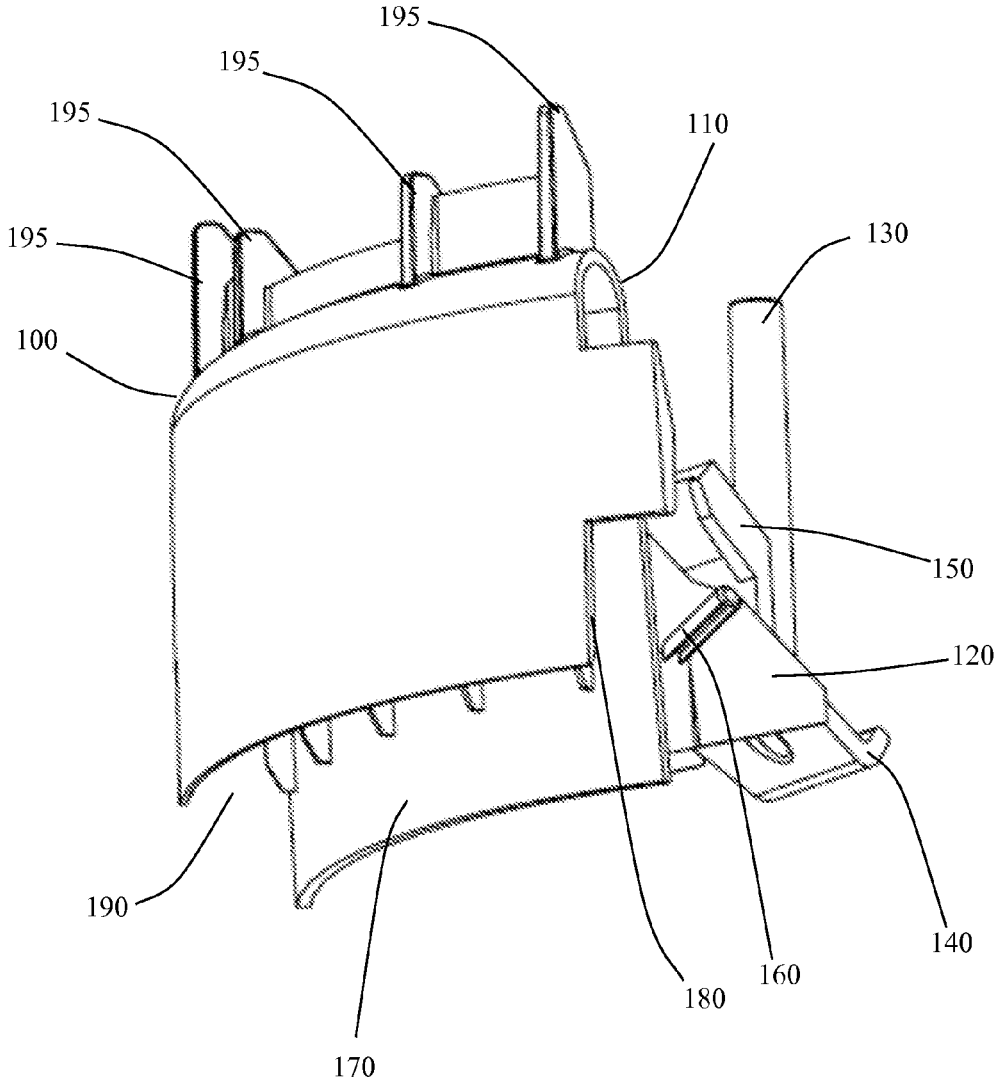
FIG. 2 is a rear perspective view of an apparatus of FIG. 1.
Figure 3:
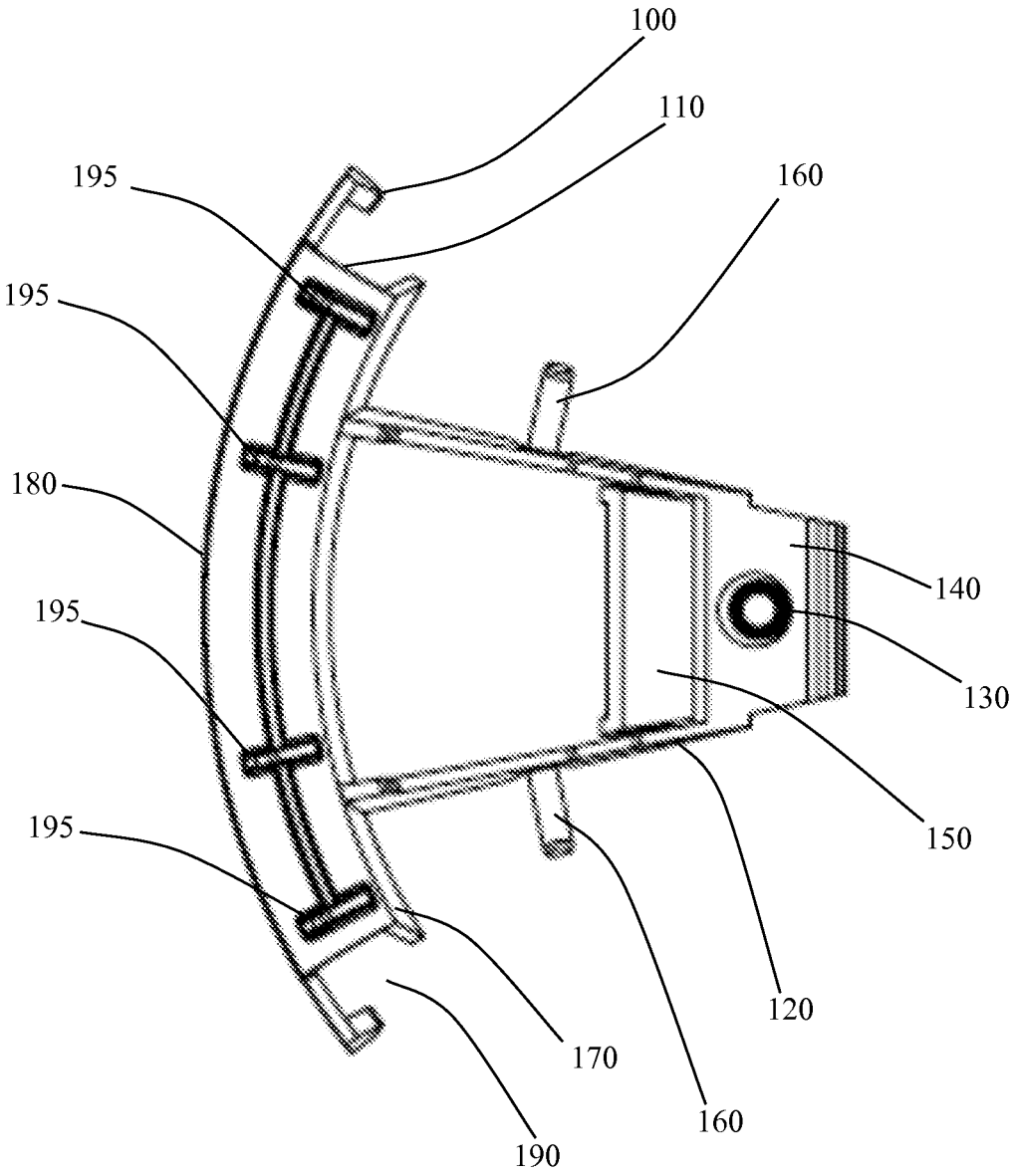
FIG. 3 is a top view of an apparatus of FIG. 1.
Figure 4:
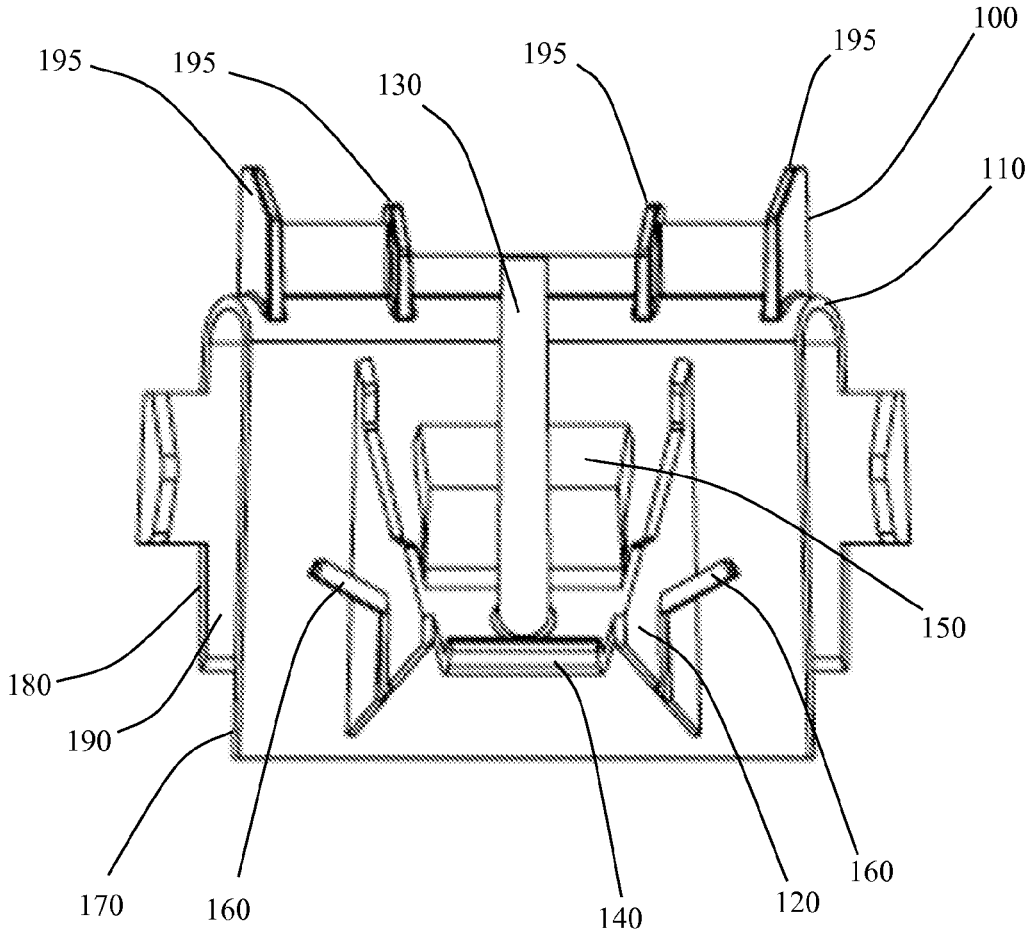
FIG. 4 is a front view of an apparatus of FIG. 1.
Figure 5:
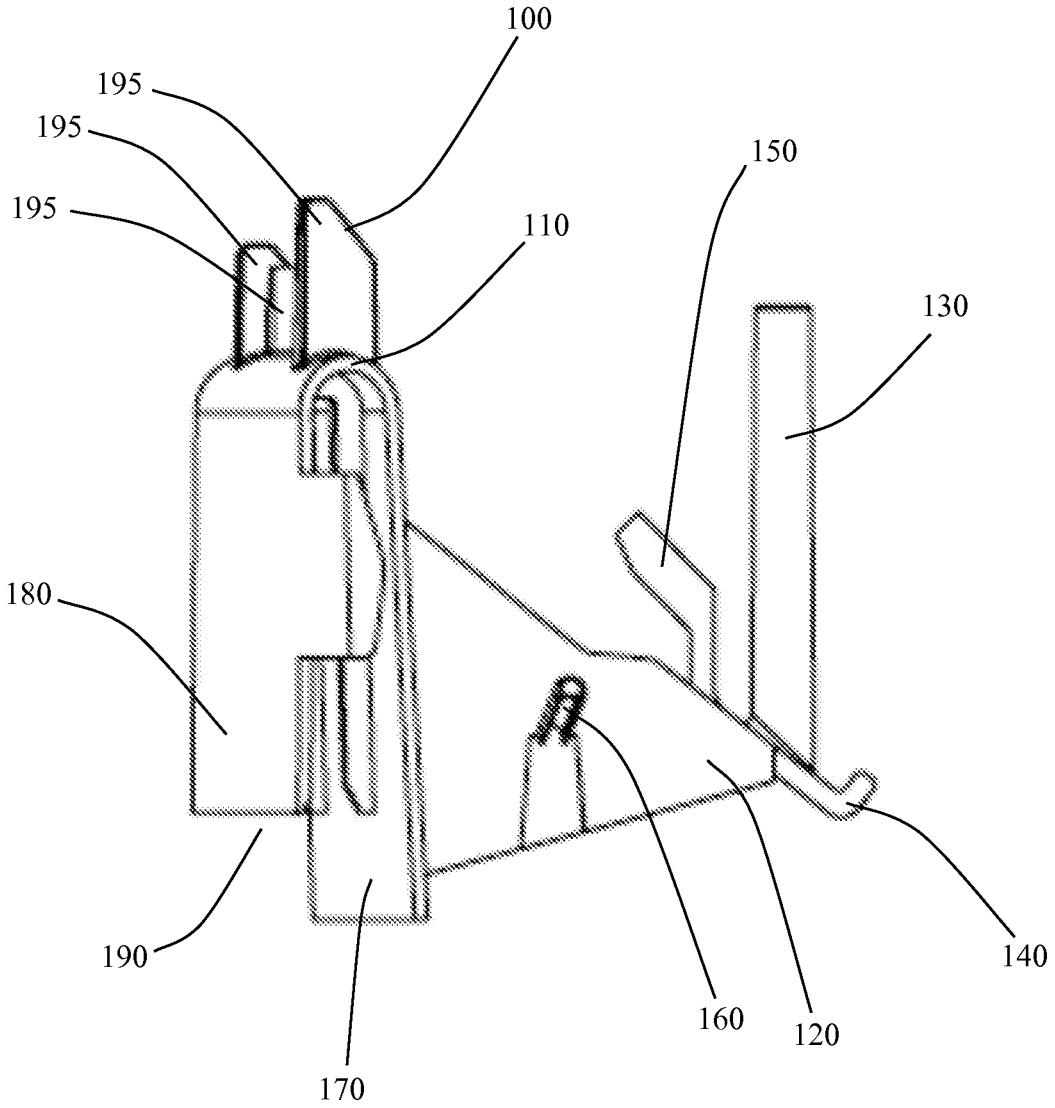
FIG. 5 is a side view of an apparatus of FIG. 1.
Figure 6:
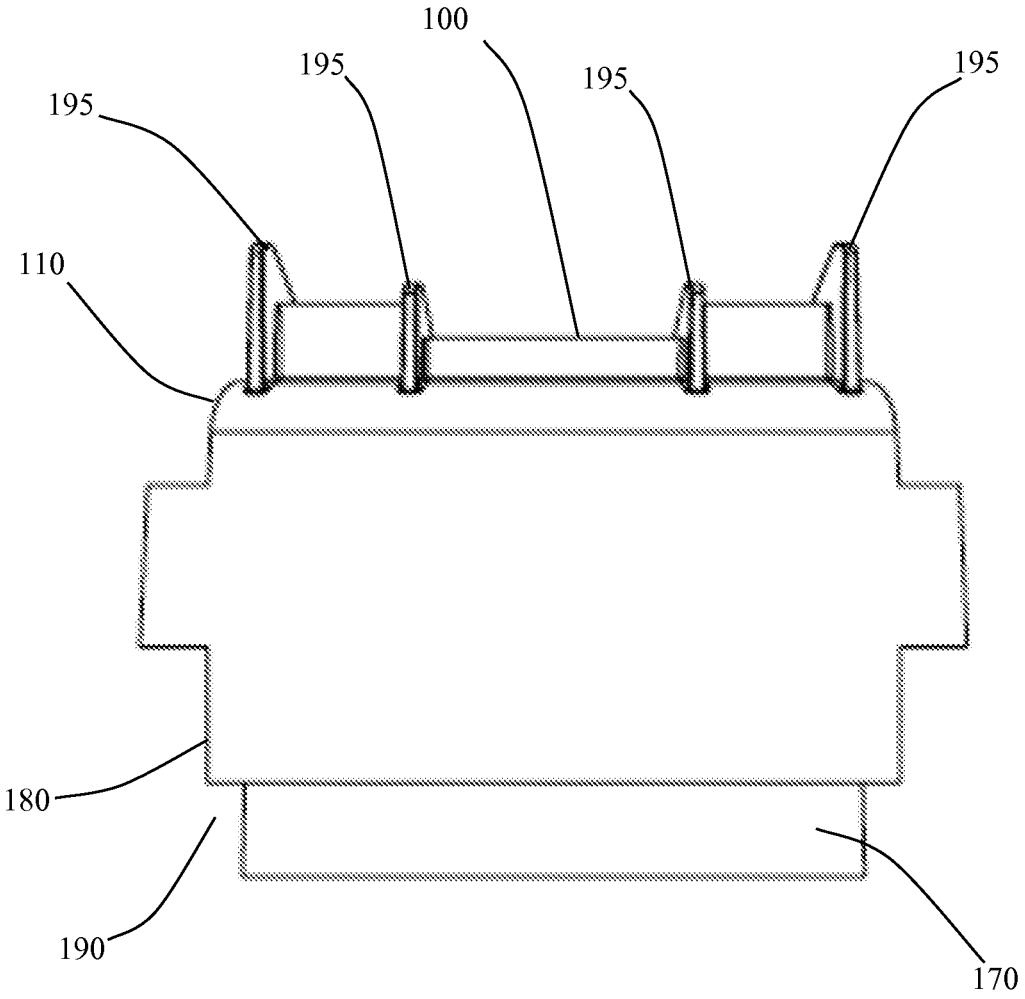
FIG. 6 is a rear view of an apparatus of FIG. 1.
Figure 7:
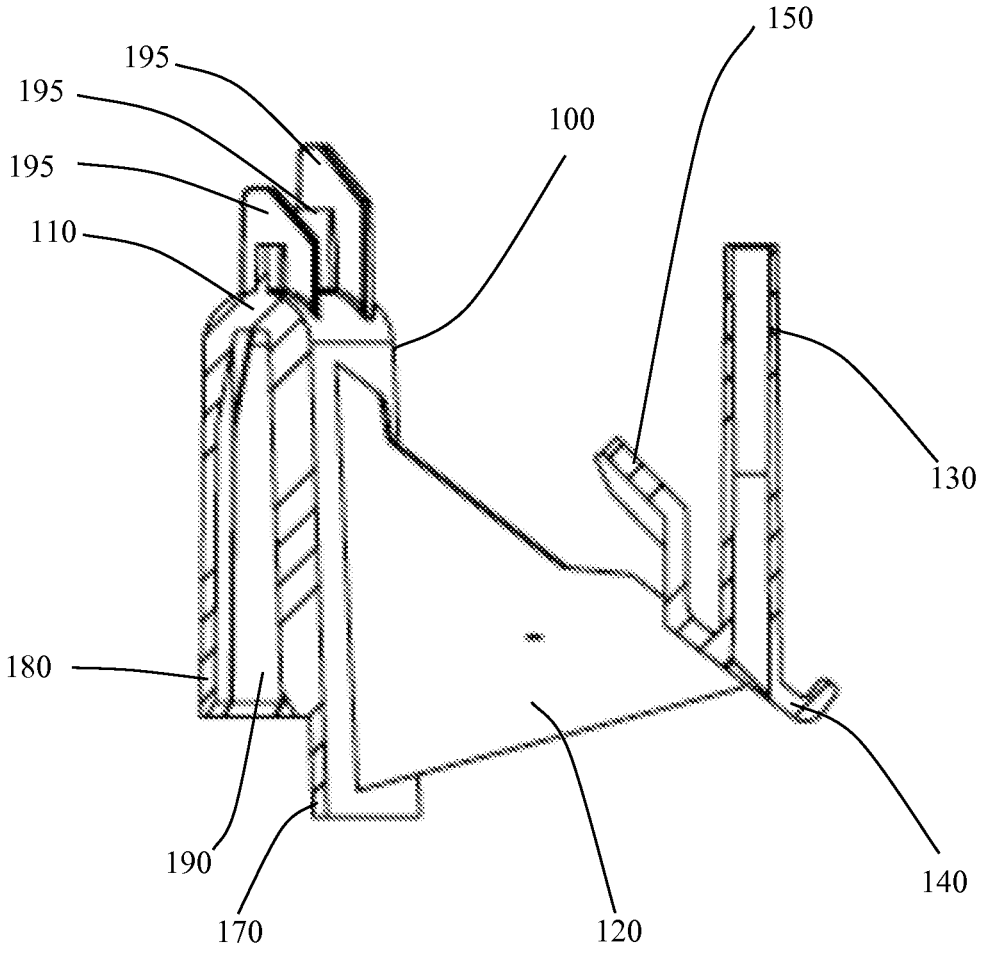
FIG. 7 is a sectional side view of an apparatus of FIG. 1.
Figure 14:
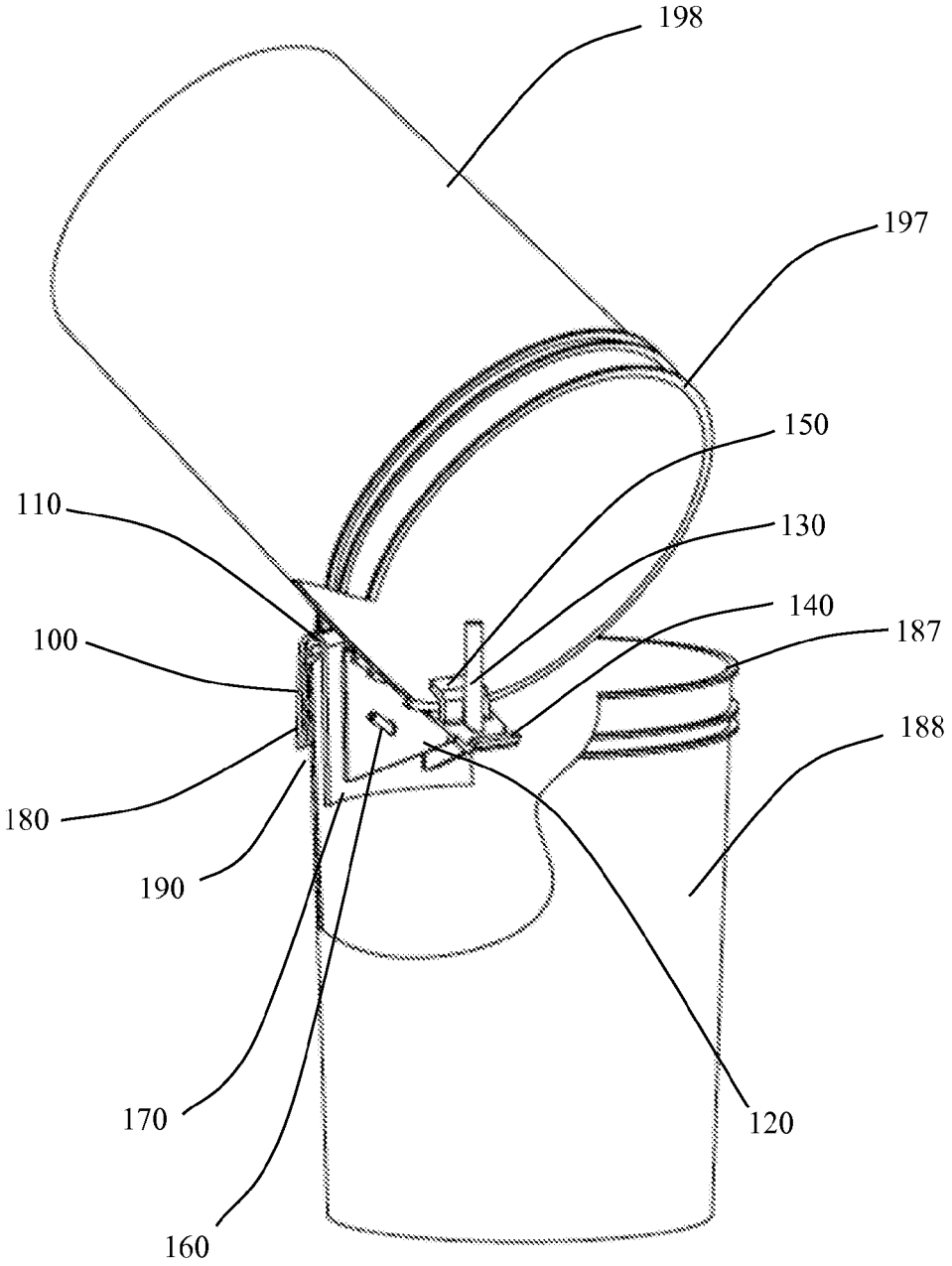
FIG. 14 is a perspective view of an apparatus of FIG. 1 showing the present invention mounted on a container and supporting another container.
Figure 15:
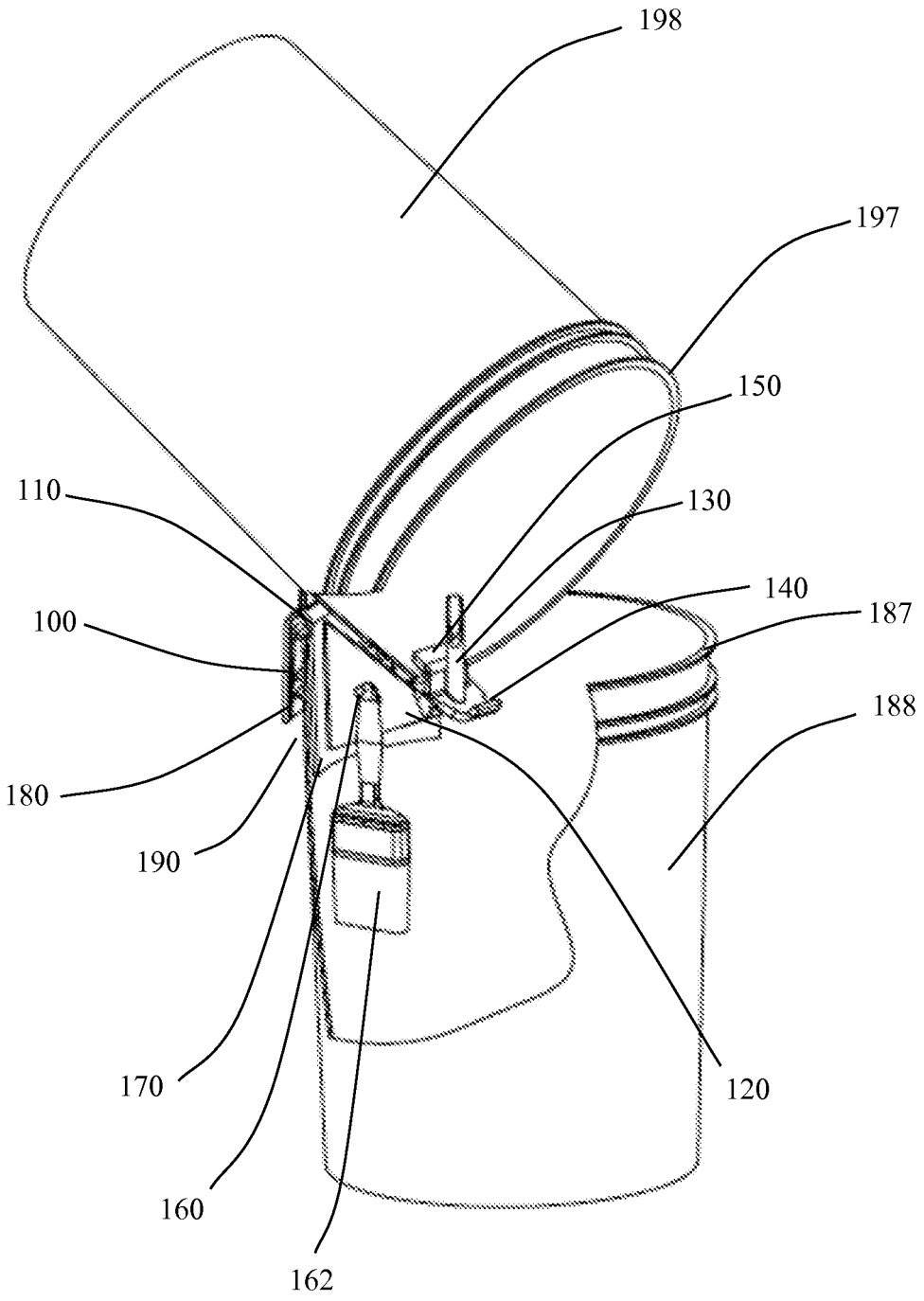
FIG. 15 is a perspective view of an apparatus of FIG. 1 showing the present invention mounted on a container, supporting another container and supporting a paint brush.
Figure 16:
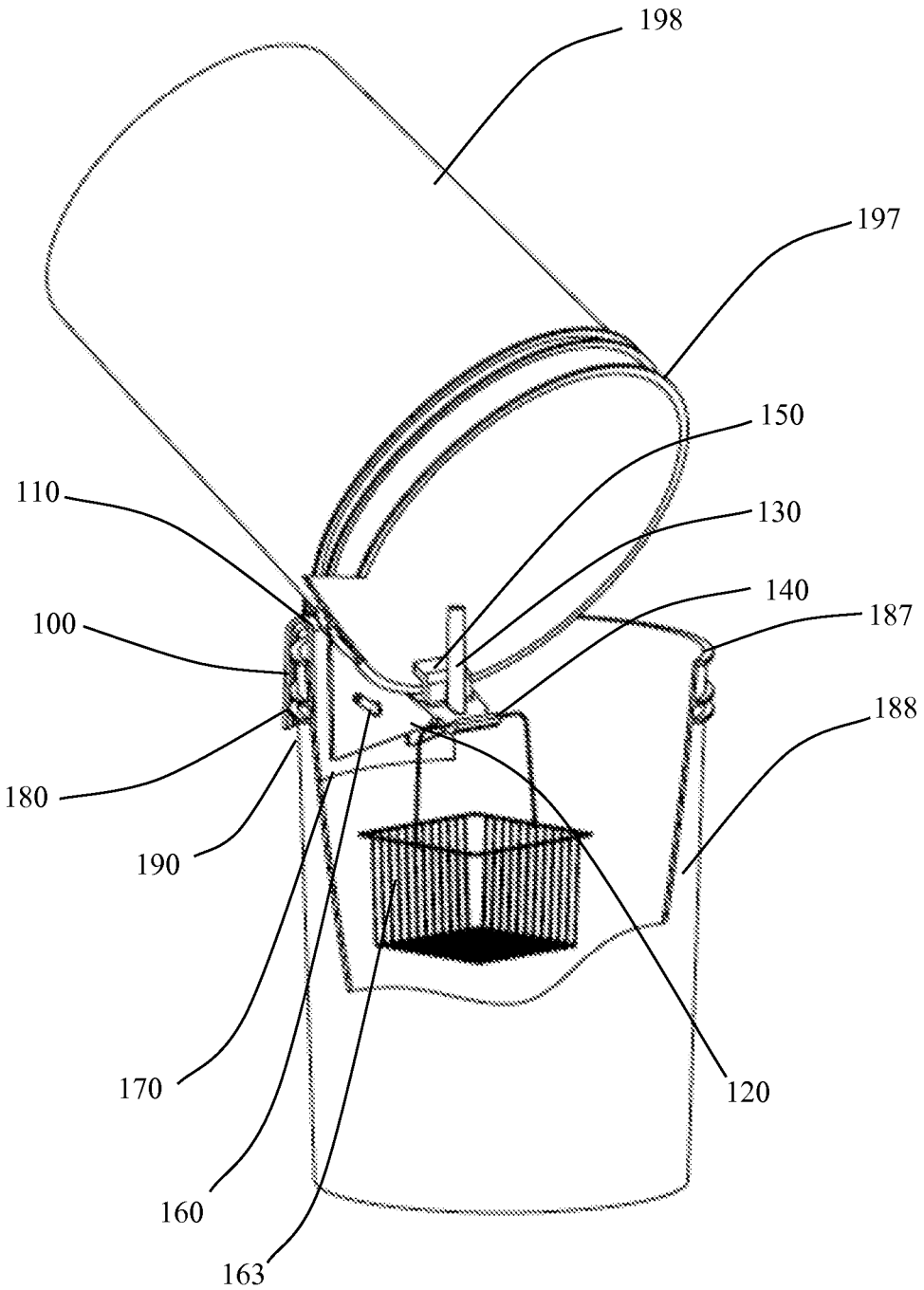
FIG. 16 is a perspective view of an apparatus of FIG. 1 showing the present invention mounted on a container, supporting another container and supporting a basket.
Figure 18:
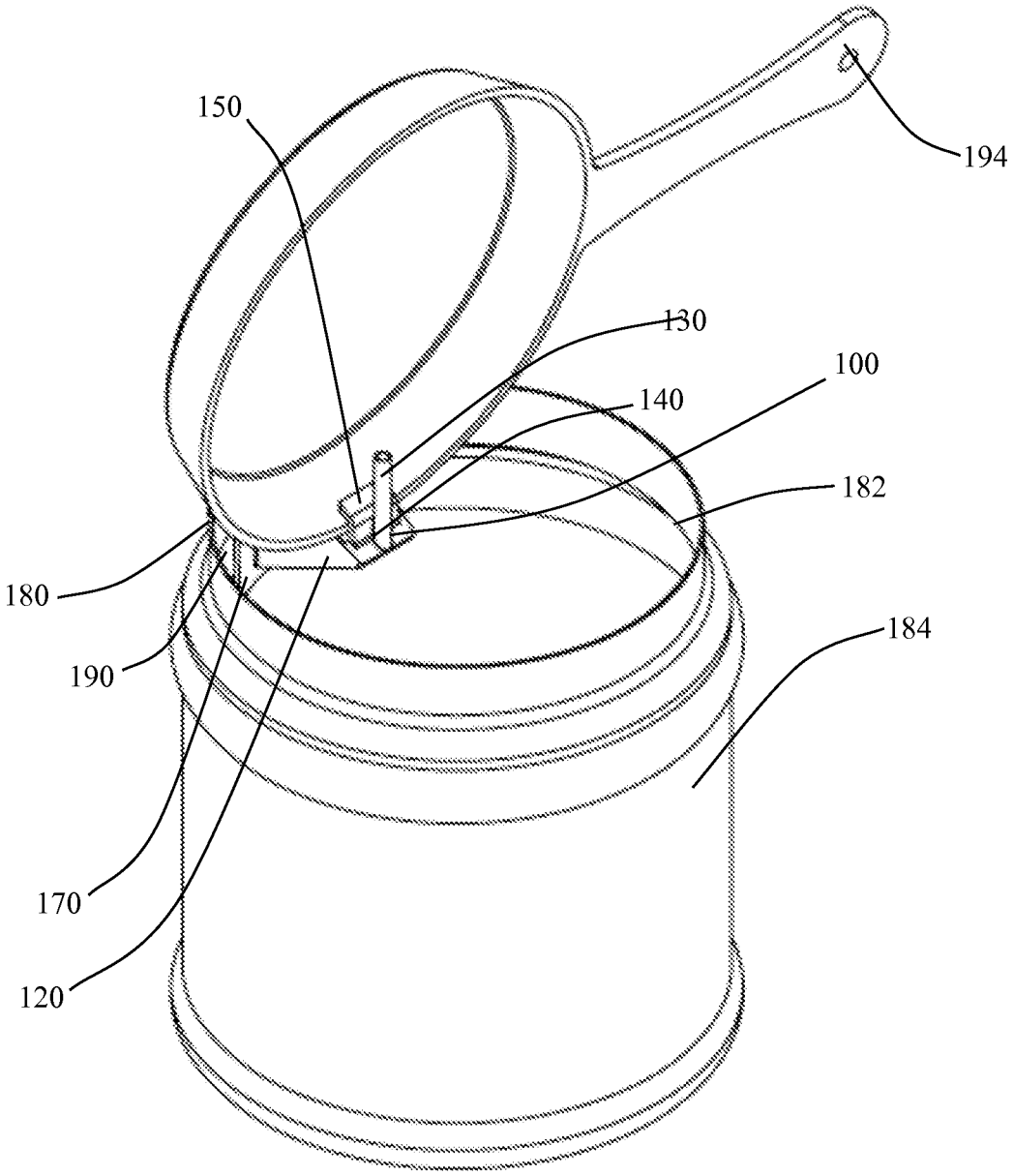
FIG. 18 is a perspective view of an apparatus of FIG. 1 showing the present invention mounted on a container and supporting a cooking pan.
Figure 19:
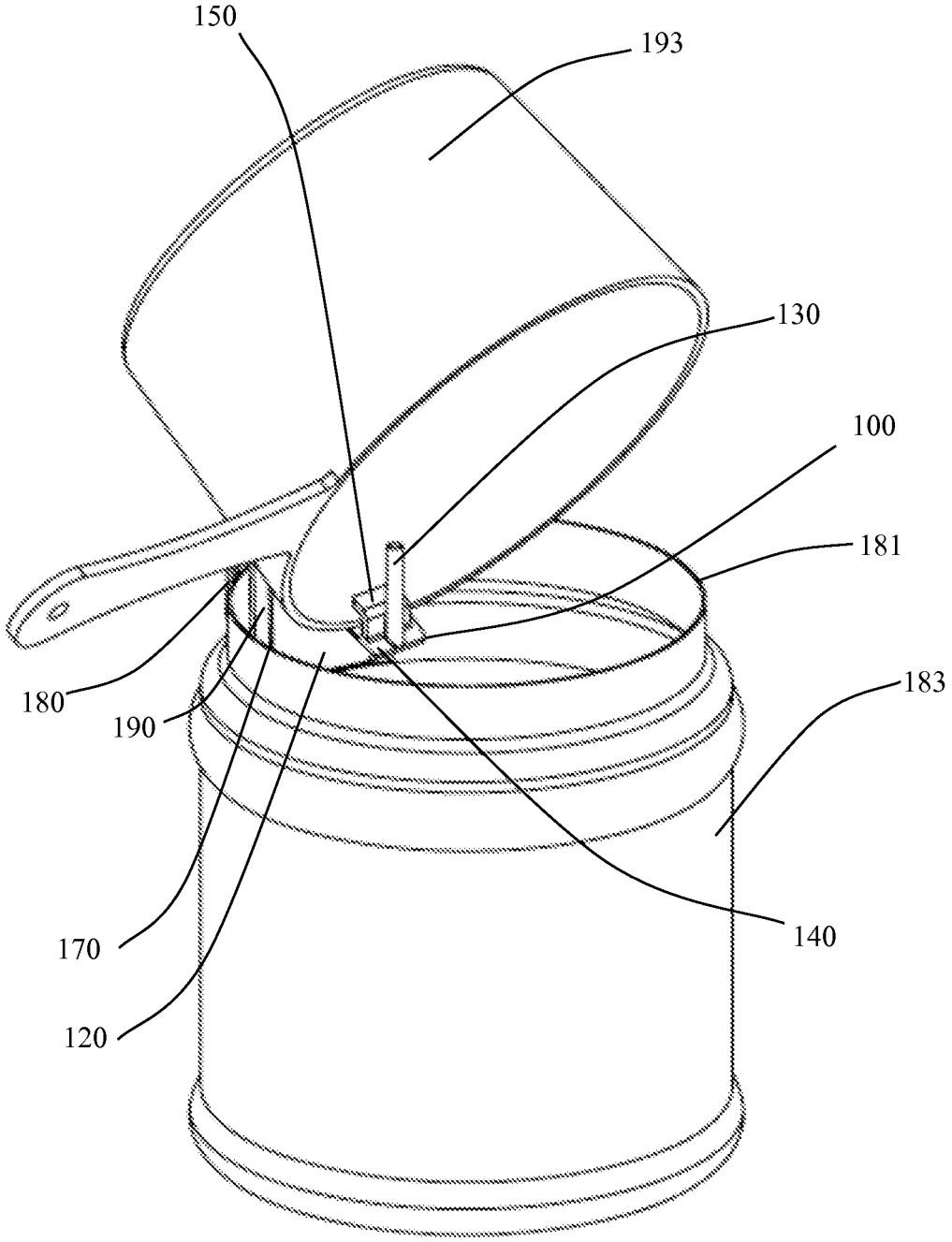
FIG. 19 is a perspective view of an apparatus of FIG. 1 showing the present invention mounted on a container and supporting a cooking pot.

Referring now to the more preferred embodiment of the invention, in FIG. 1, FIG. 2, FIG. 3, FIG. 4, FIG. 5, FIG. 6, FIG. 7, FIG. 14, FIG. 15, FIG. 16, FIG. 18 and FIG. 19, a Container Drip Draining Device 100 is shown. FIG. 1 demonstrates a front perspective view of a Container Drip Draining Device 100. FIG. 2 illustrates a rear perspective view of a Container Drip Draining Device 100. FIG. 3 depicts a top view of a Container Drip Draining Device 100. FIG. 4 shows a front view of a Container Drip Draining Device 100. FIG. 5 displays a side view of a Container Drip Draining Device 100. FIG. 6 demonstrates a rear view of a Container Drip Draining Device 100. FIG. 7 shows a sectional side view of a Container Drip Draining Device 100. FIG. 14 displays a perspective view of a Container Drip Draining Device 100, which shows the Container Drip Draining Device 100 mounted on a supporting container 188, which is an open-mouthed bucket, and supporting another draining container 198, which is another open-mouthed bucket. FIG. 15 illustrates a perspective view of a Container Drip Draining Device 100, which shows the Container Drip Draining Device 100 mounted on a supporting container 188, which is an open-mouthed bucket, supporting another draining container 198, which is another open-mouthed bucket, and supporting a paint brush 162. FIG. 16 shows a perspective view of a Container Drip Draining Device 100, which shows the Container Drip Draining Device 100 mounted on a supporting container 188, which is an open-mouthed bucket, supporting another draining container 198, which is another open-mouthed bucket, and supporting a basket 163. FIG. 18 demonstrates a perspective view of a Container Drip Draining Device 100 being used in a kitchen and shows the Container Drip Draining Device 100 mounted on a supporting kitchen container 184, supporting a cooking pan 194. FIG. 19 illustrates a perspective view of a Container Drip Draining Device 100 being used in a kitchen and shows the Container Drip Draining Device 100 mounted on a supporting kitchen container 184, supporting a cooking pot 193.

In further detail, still referring to the invention of FIG. 1, FIG. 2, FIG. 3, FIG. 4, FIG. 5, FIG. 6, FIG. 7, FIG. 14, FIG. 15, FIG. 16, FIG. 18 and FIG. 19, a Container Drip Draining Device 100 comprises an inner wall 170 and an outer wall 180, which are separated by a gap 190, a wall connector 110, which connects the inner wall 170 to the outer wall 180, and a support extension 120, which distends from the inner wall 170. A support tongue 150 upwardly distends from the support extension 120 and provides support for the draining edge 197 of a draining container 198. A support post 130 upwardly distends from the support extension 120 and allows for additional small containers to be supported in an upside-down fashion to facilitate drainage of smaller containers. A plurality of support pegs 160 distend from the sides of the support extension 120 and allow for tools, such as paintbrushes, mixers or the like, to be suspended therefrom. A support hook 140 extends from the end of the support extension 120 and allows for baskets, filters or the like to be suspended therefrom. A plurality of reinforcement members 195 upwardly distend from the wall connector 110 and provide added strength when the Container Drip Draining Device 100 supports a container. During use, a user positions a Container Drip Draining Device 100 over the supporting edge 187 of a supporting container 188, so that the supporting edge 187 fits tightly into the gap 190 between the inner wall 170 and the outer wall 180 and the support extension 120 protrudes into the inside of the supporting container 188. Next, a user positions a draining container 198 onto the Container Drip Draining Device 100 by inserting the draining edge 197 of the draining container 198 into the support tongue 150 on the support extension 120. When the user releases the draining container 198, the Container Drip Draining Device 100 stably supports the draining container 198 on the edge of the supporting container 188 at an angle sufficient to facilitate the efficient draining of the draining container 198 into the supporting container 188. A paintbrush 162, utensil, other tool, or the like, may be suspended from a support peg 160 in order to drain the paintbrush 162 into the supporting container 188. A basket 163 may be suspended from a support hook 140 so that smaller items may be supported while they are being drained into the supporting container 188. Additionally, other items, such as a filter, sieve or screen, or the like, may be suspended from the support hook 140 so that the fluid being drained out of the draining container 198 may be filtered, sieved or screened of undesired material while it is being drained into the supporting container 188. A smaller version of a Container Drip Draining Device 100 may also be used for kitchen applications, such as draining and straining pots or pans, as seen in FIG. 18 and FIG. 19.

The construction details of the invention as shown in FIG. 1, FIG. 2, FIG. 3, FIG. 4, FIG. 5, FIG. 6, FIG. 7, FIG. 14, FIG. 15, FIG. 16, FIG. 18 and FIG. 19, are that a Container Drip Draining Device 100 is a singular construction, which comprises an inner wall 170 and an outer wall 180, which are separated by a gap 190, a wall connector 110, which connects the inner wall 170 to the outer wall 180, and a support extension 120, which distends from the inner wall 170. As part of the singular construction, a support tongue 150 upwardly distends from the support extension 120 and provides support for the draining edge 197 of a draining container 198. As part of the singular construction, a support post 130 upwardly distends from the support extension 120 and allows for additional small containers to be supported in an upside-down fashion to facilitate drainage of smaller containers. As part of the singular construction, a plurality of support pegs 160 distend from the sides of the support extension 120 and allow for tools, such as paintbrushes, mixers or the like, to be suspended therefrom. As part of the singular construction, a support hook 140 extends from the end of the support extension 120 and allows for baskets, filters or the like to be suspended therefrom. As part of the singular construction, a plurality of reinforcement members 195 upwardly distend from the wall connector 110 and provide added strength when the Container Drip Draining Device 100 supports a container. The singular construction of a Container Drip Draining Device 100 comprises plastic, high density plastic, silicone, PVC, composite material, metal, steel, galvanized steel, stainless steel, aluminum, brass, copper, or other like material, which has sufficient strength to support a draining container, along with its contents, upon the lip of a receiving container.

Figure 8:
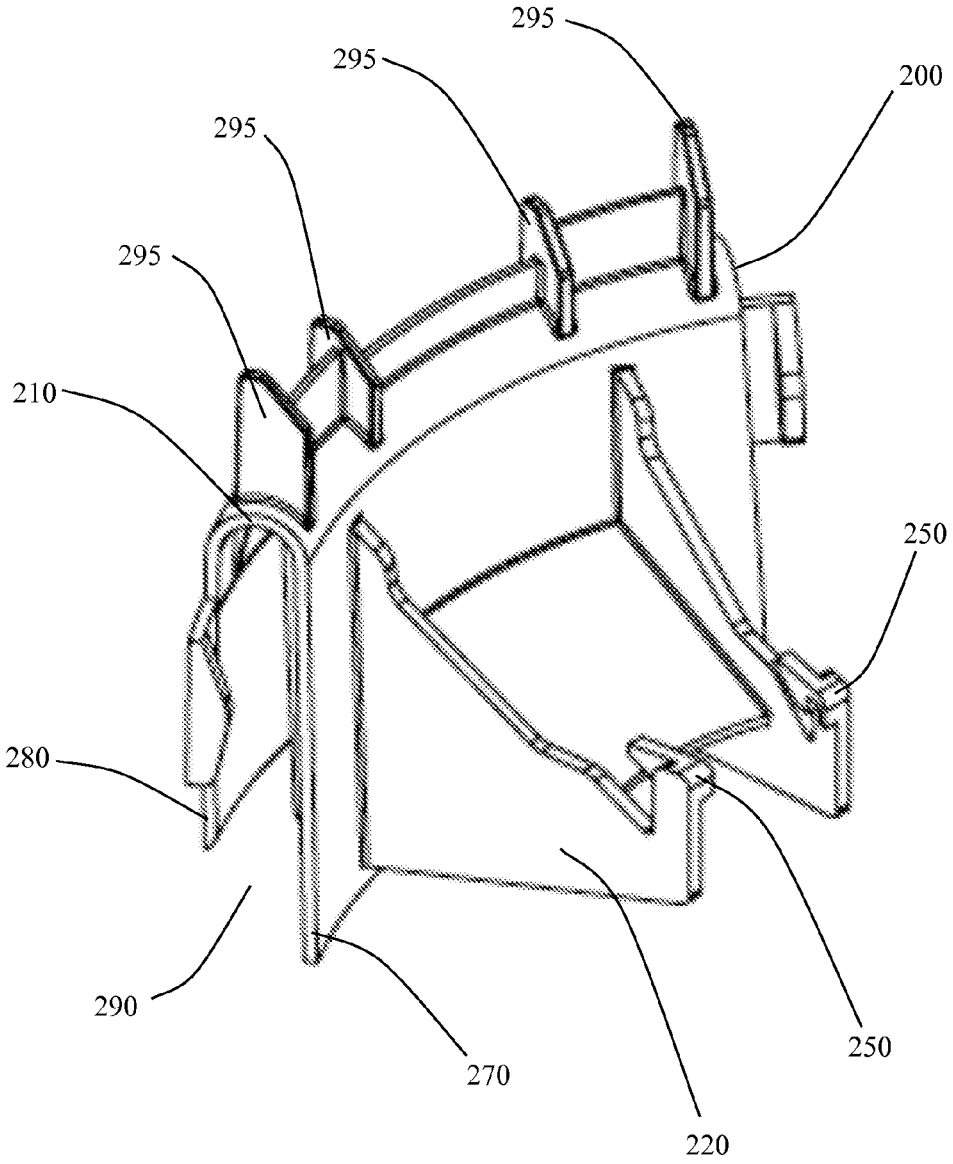
FIG. 8 is a front perspective view of an apparatus of the present invention.
Figure 9:
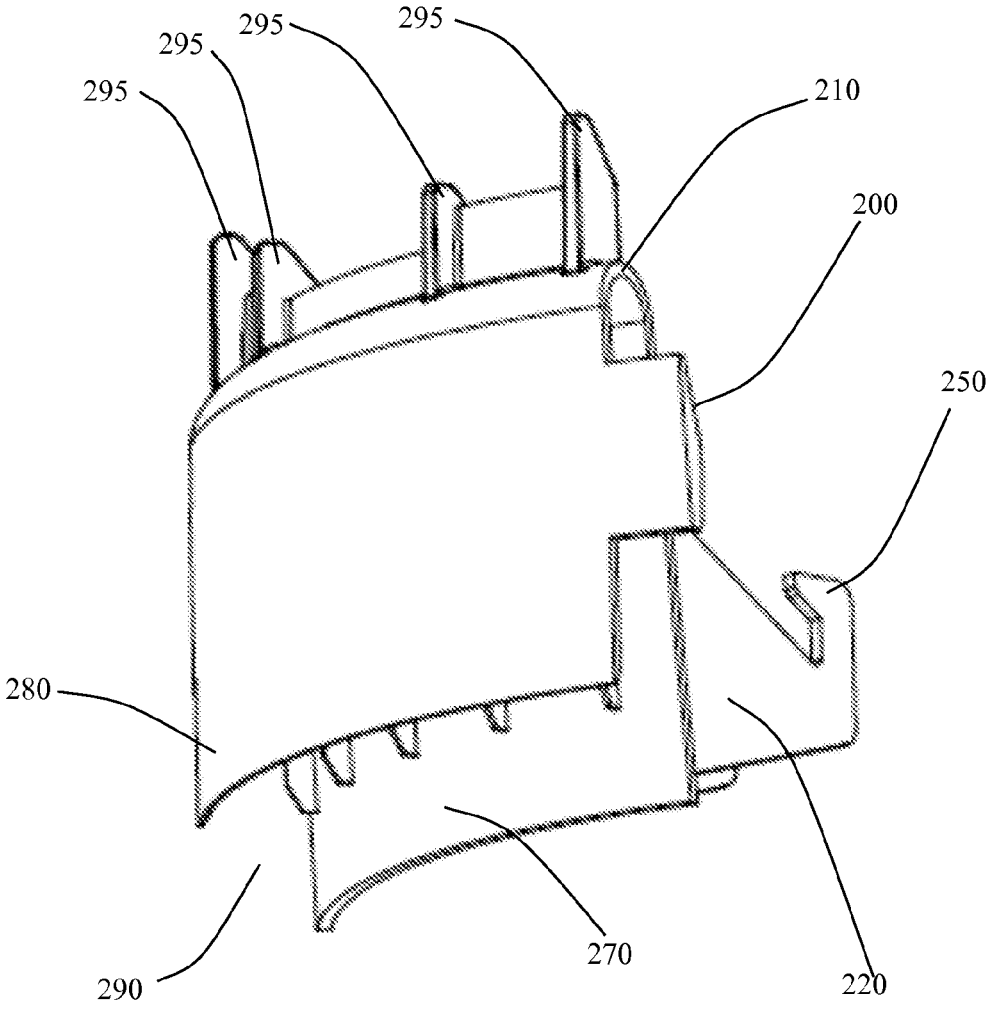
FIG. 9 is a rear perspective view of an apparatus of FIG. 8.
Figure 10:
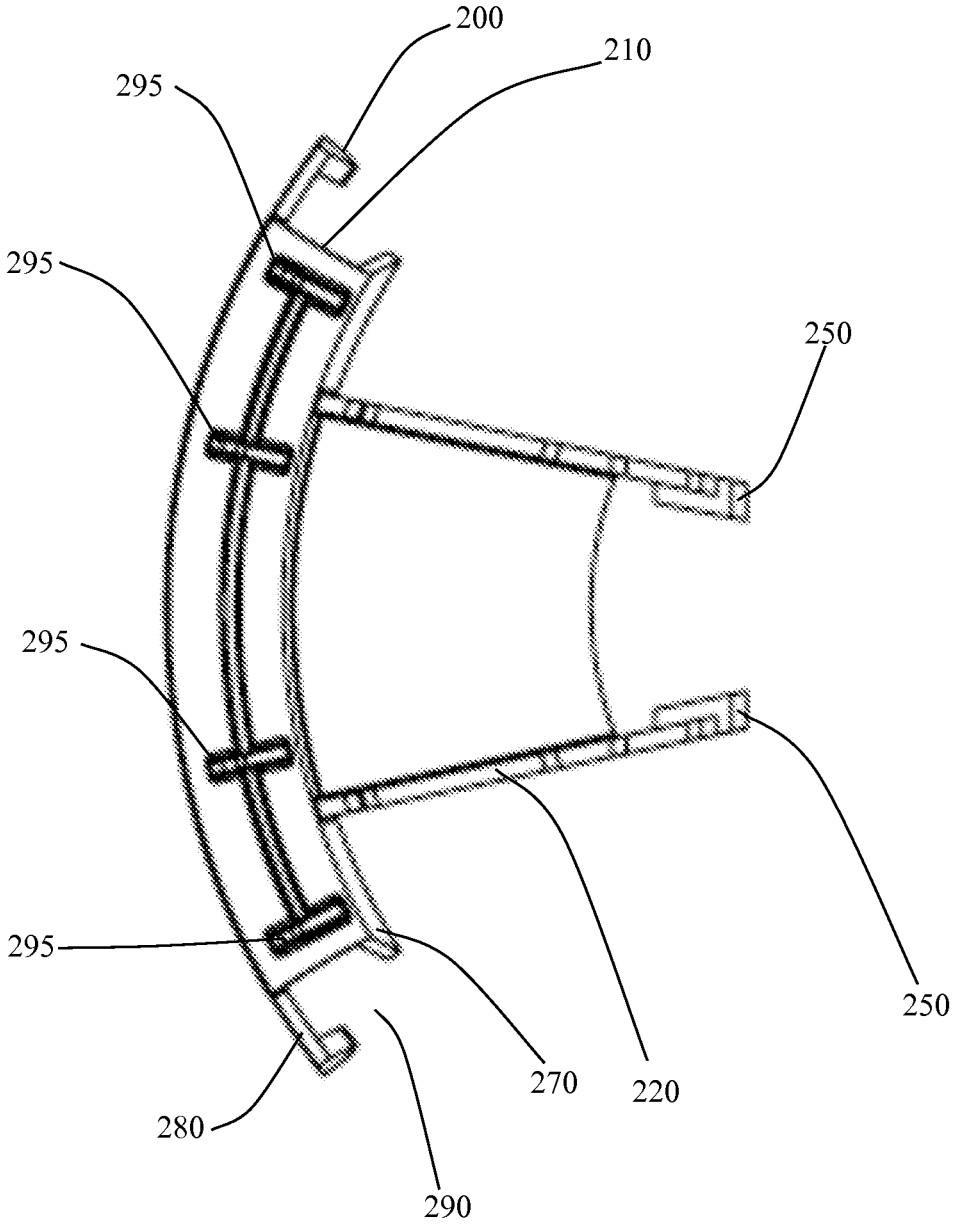
FIG. 10 is a top view of an apparatus of FIG. 8.
Figure 11:
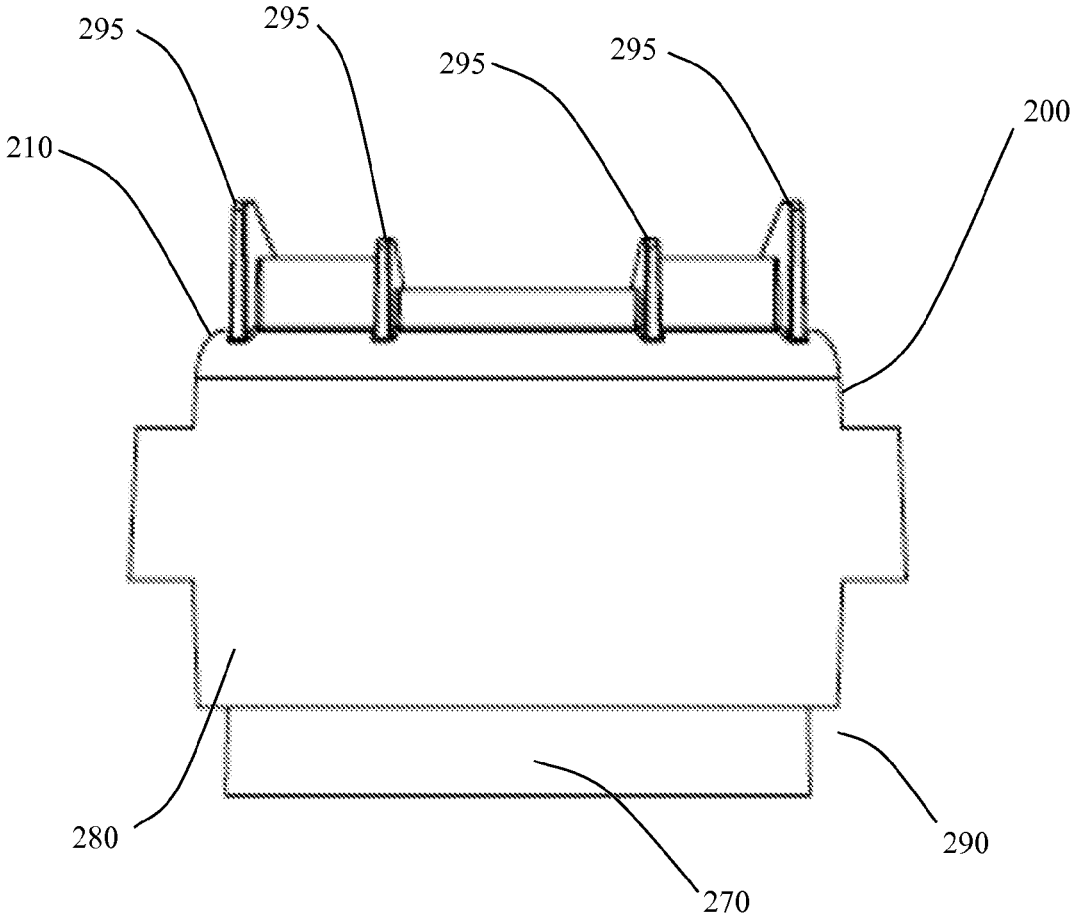
FIG. 11 is a rear view of an apparatus of FIG. 8.
Figure 12:
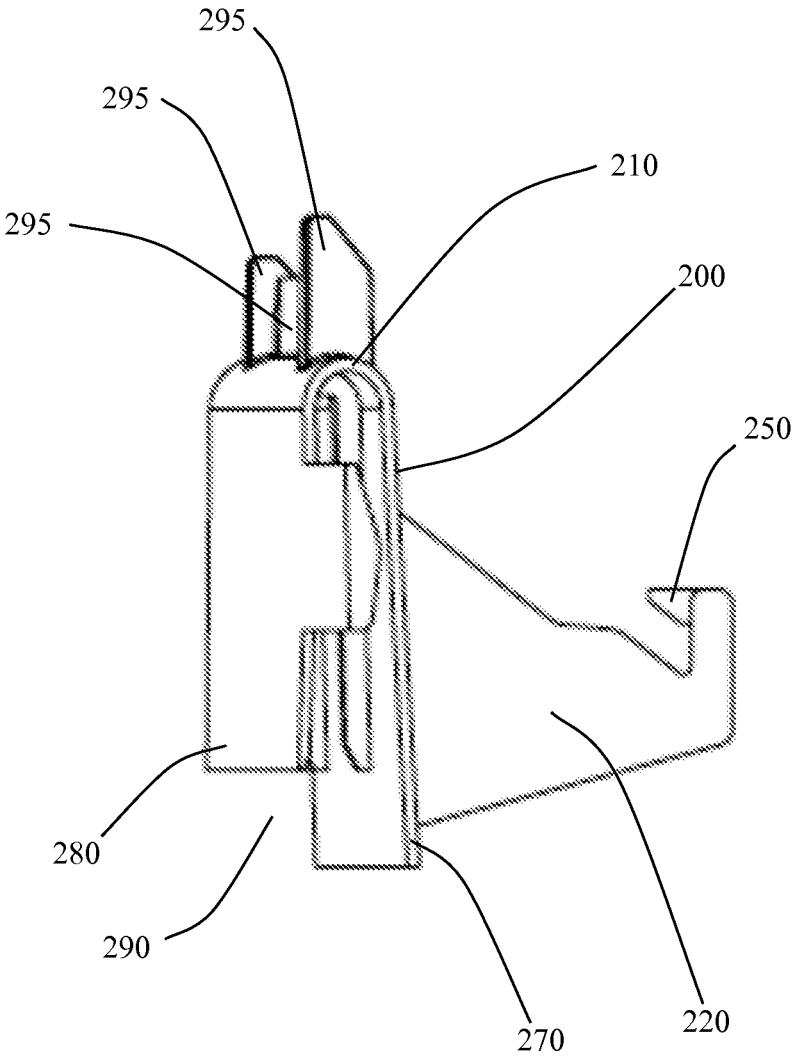
FIG. 12 is a side view of an apparatus of FIG. 8.
Figure 13:
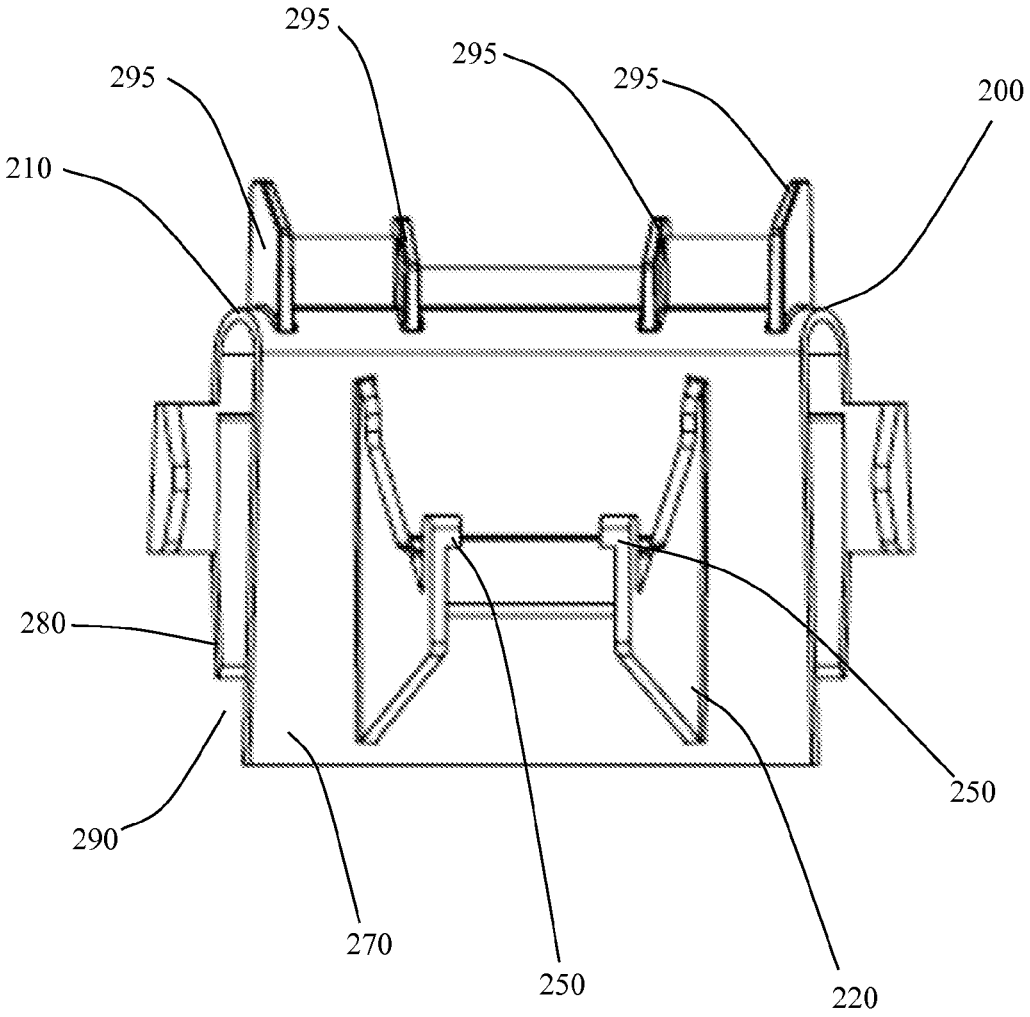
FIG. 13 is a front view of an apparatus of FIG. 8.
Figure 17:
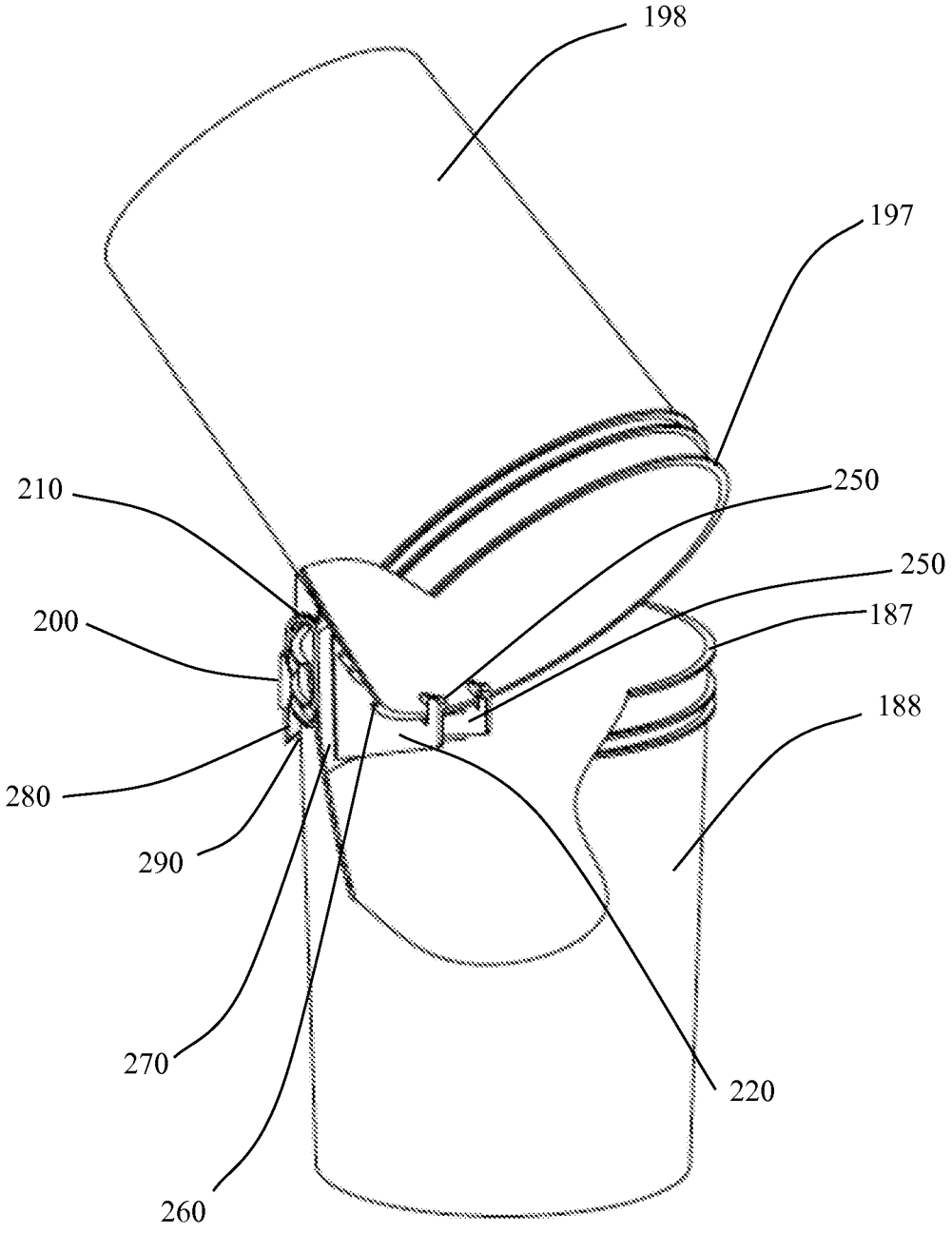
FIG. 17 is a perspective view of an apparatus of FIG. 8 showing the present invention mounted on a container and supporting another container.

In further detail, referring now to another preferred embodiment of the present invention, in FIG. 8, FIG. 9, FIG. 10, FIG. 11, FIG. 12, FIG. 13 and FIG. 17, a Container Drip Draining Device 200 is shown. FIG. 8 demonstrates a front perspective view of a Container Drip Draining Device 200. FIG. 9 illustrates a rear perspective view of a Container Drip Draining Device 200. FIG. 10 depicts a top view of a Container Drip Draining Device 200. FIG. 11 shows a rear view of a Container Drip Draining Device 200. FIG. 12 displays a side view of a Container Drip Draining Device 200. FIG. 13 demonstrates a front view of a Container Drip Draining Device 200. FIG. 17 displays a perspective view of a Container Drip Draining Device 200, which shows the Container Drip Draining Device 200 mounted on a supporting container 188, which is an open-mouthed bucket, and supporting another draining container 198, which is another open-mouthed bucket.

In further detail, still referring to the invention of FIG. 8, FIG. 9, FIG. 10, FIG. 11, FIG. 12, FIG. 13 and FIG. 17, a Container Drip Draining Device 200 comprises an inner wall 270 and an outer wall 280, which are separated by a gap 290, a wall connector 210, which connects the inner wall 270 to the outer wall 280, and a support extension 220, which distends from the inner wall 270. A pair of support tongues 250 extends from the end of the support extension 220 and provides support for the draining edge 197 of a draining container 198. A plurality of reinforcement members 295 upwardly distend from the wall connector 210 and provide added strength when the Container Drip Draining Device 200 supports a container. During use, a user positions a Container Drip Draining Device 200 over the supporting edge 187 of a supporting container 188, so that the supporting edge 187 fits tightly into the gap 290 between the inner wall 270 and the outer wall 280 and the support extension 220 protrudes into the inside of the supporting container 188. Next, a user positions a draining container 198 onto the Container Drip Draining Device 200 by inserting the draining edge 197 of the draining container 198 into the support tongues 250 on the support extension 220. When the user releases the draining container 198, the Container Drip Draining Device 200 stably supports the draining container 198 on the edge of the supporting container 188 at an angle sufficient to facilitate the efficient draining of the draining container 198 into the supporting container 188.

The construction details of the invention as shown in FIG. 8, FIG. 9, FIG. 10, FIG. 11, FIG. 12, FIG. 13 and FIG. 17, are that a Container Drip Draining Device 200 is a singular construction, which comprises an inner wall 270 and an outer wall 280, which are separated by a gap 290, a wall connector 210, which connects the inner wall 270 to the outer wall 280, and a support extension 220, which distends from the inner wall 270. As part of the singular construction, a pair of support tongues 250 extends from the support extension 220 and provides support for the draining edge 197 of a draining container 198. As part of the singular construction, a plurality of reinforcement members 295 upwardly distend from the wall connector 210 and provide added strength when the Container Drip Draining Device 200 supports a container. The singular construction of a Container Drip Draining Device 200 comprises plastic, high density plastic, silicone, PVC, composite material, metal, steel, galvanized steel, stainless steel, aluminum, brass, copper, or other like material, which has sufficient strength to support a draining container, along with its contents, upon the lip of a receiving container.

Figure 20:
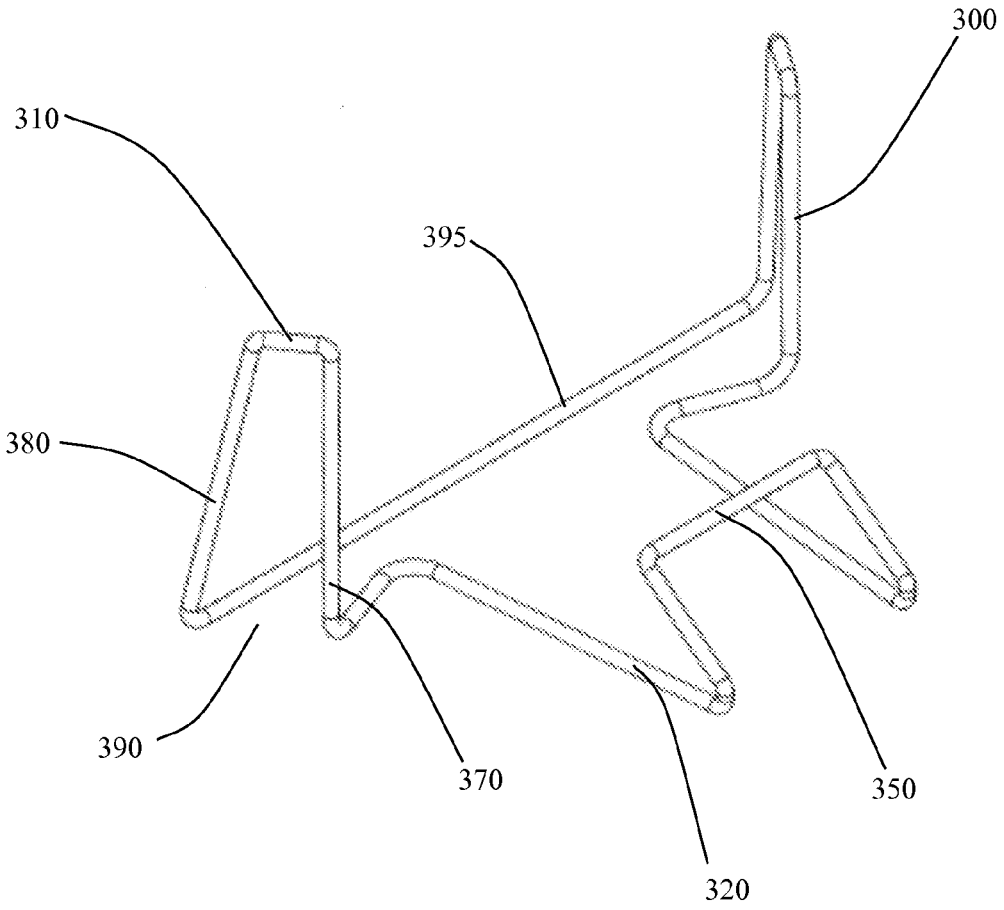
FIG. 20 is a front perspective view of an apparatus of the present invention.
Figure 21:
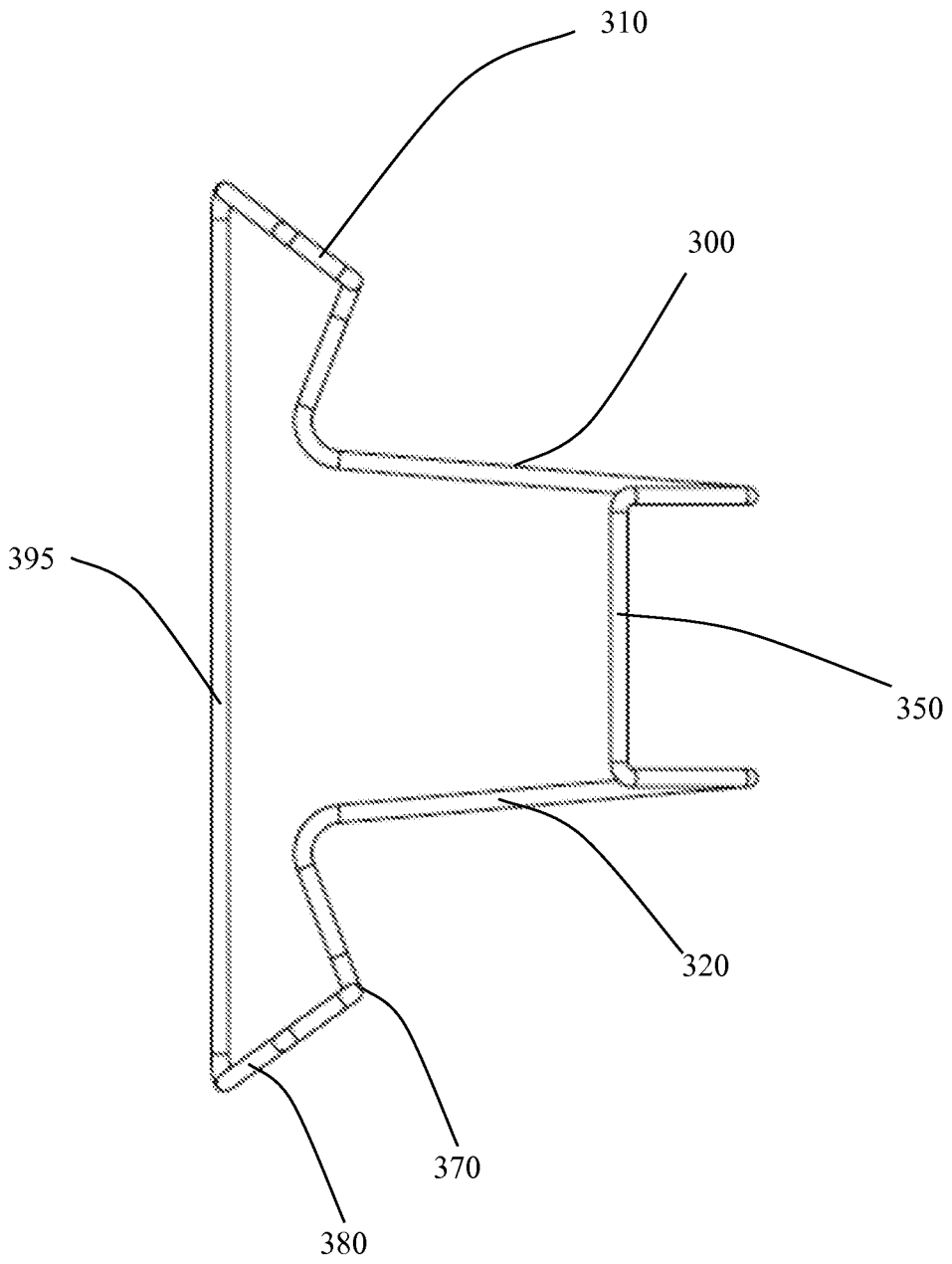
FIG. 21 is a top view of an apparatus of FIG. 20.
Figure 22:
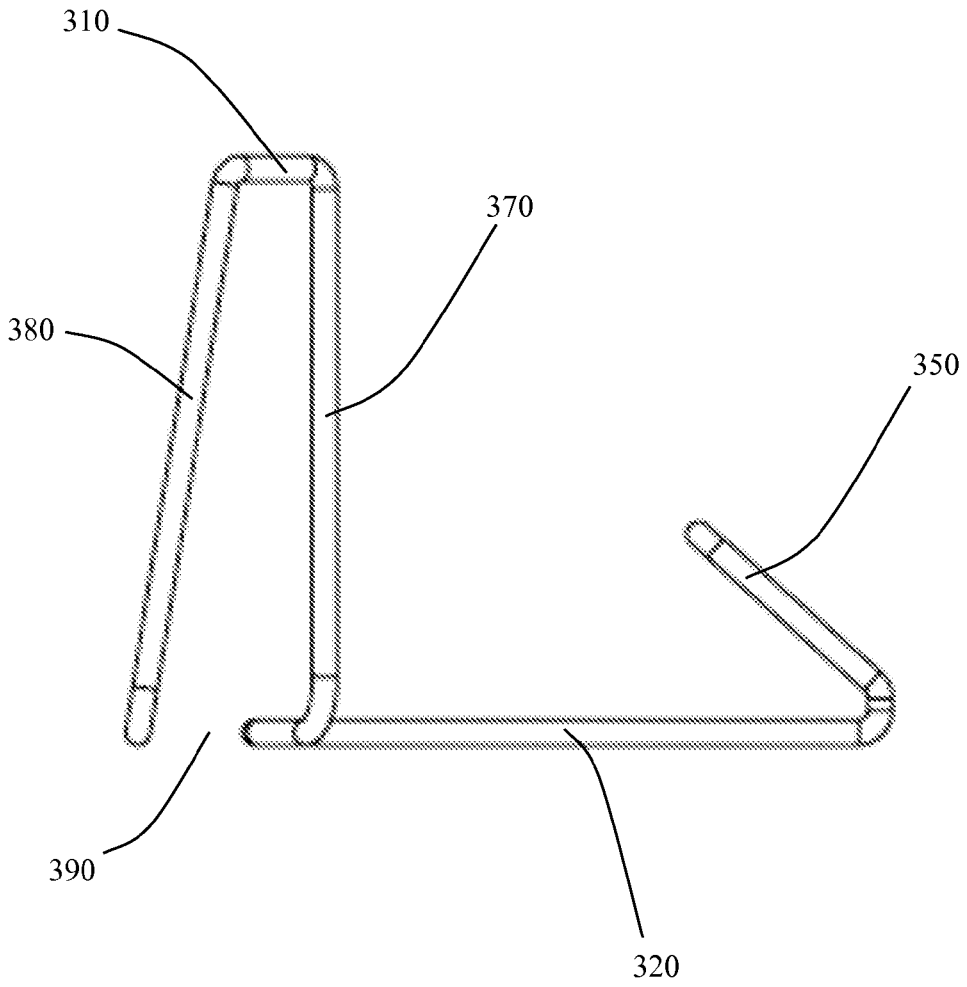
FIG. 22 is a side view of an apparatus of FIG. 20.
Figure 23:
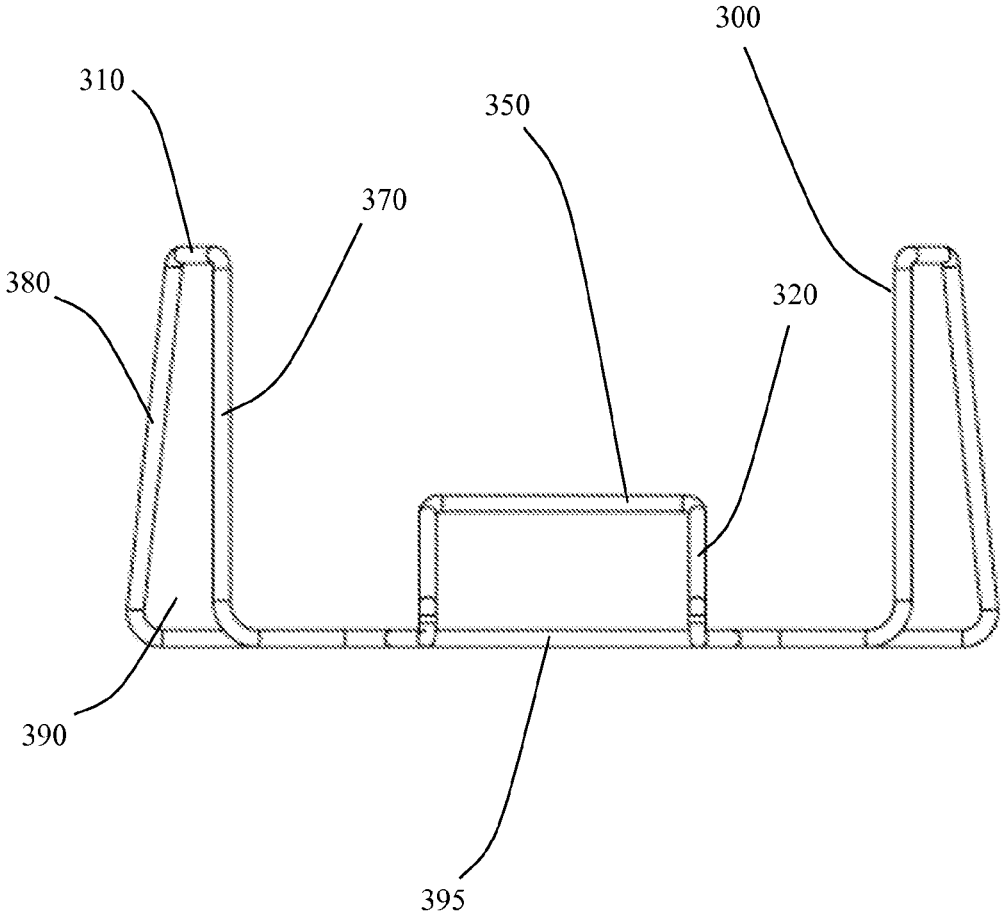
FIG. 23 is a front view of an apparatus of FIG. 20.
Figure 24:
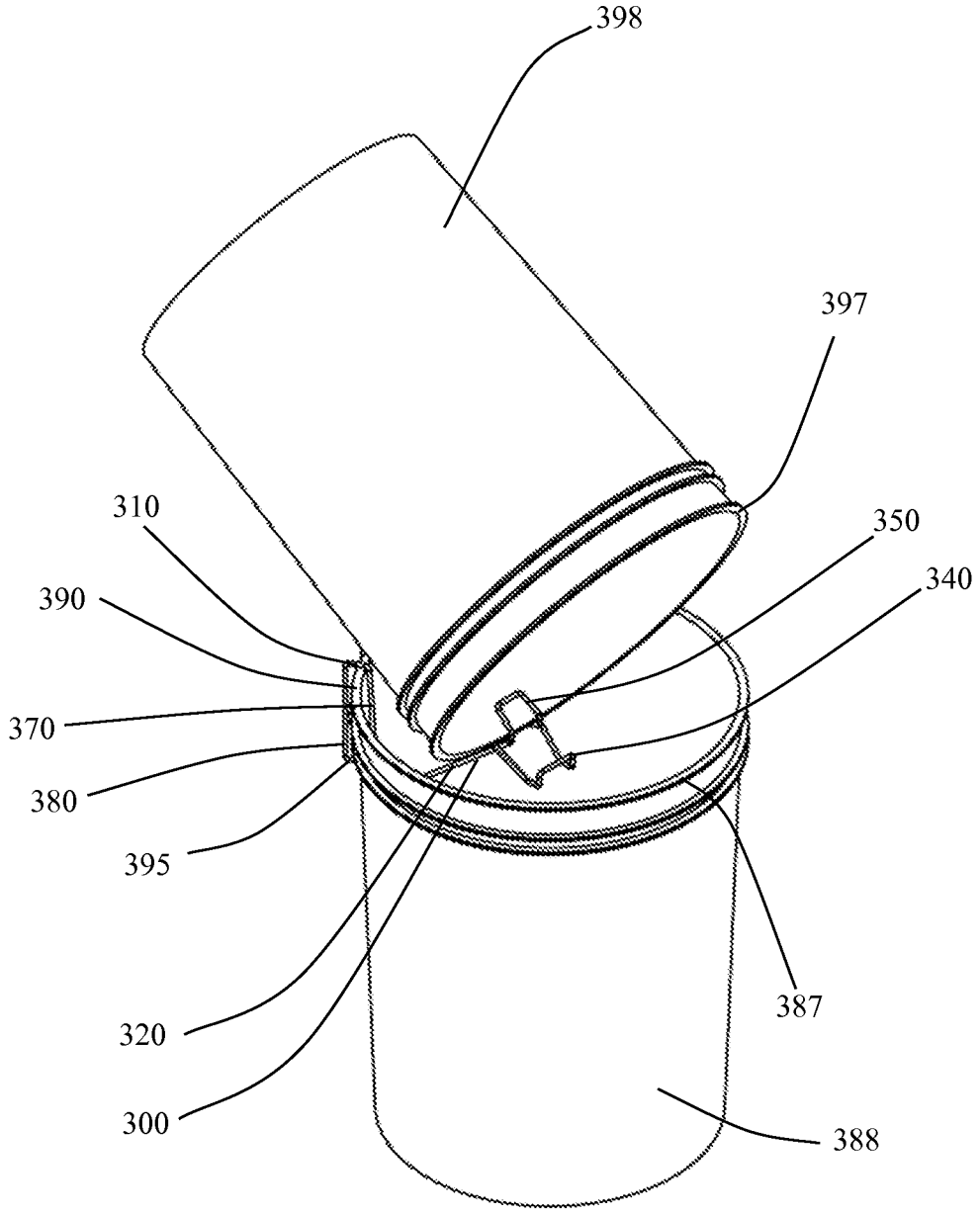
FIG. 24 is a perspective view of an apparatus of FIG. 20 showing the present invention mounted on a container and supporting another container.

In further detail, referring now to another preferred embodiment of the present invention, in FIG. 20, FIG. 21, FIG. 22, FIG. 23 and FIG. 24, a Container Drip Draining Device 300 is shown. A Container Drip Draining Device 300 is used for larger containers. FIG. 20 demonstrates a front perspective view of a Container Drip Draining Device 300. FIG. 21 depicts a top view of a Container Drip Draining Device 300. FIG. 22 shows a side view of a Container Drip Draining Device 300. FIG. 23 demonstrates a front view of a Container Drip Draining Device 300. FIG. 24 displays a perspective view of a Container Drip Draining Device 300, which shows the Container Drip Draining Device 300 mounted on a larger supporting container 388, which is an open-mouthed bucket, and supporting another larger draining container 398, which is another open-mouthed bucket.

In further detail, still referring to the invention of FIG. 20, FIG. 21, FIG. 22, FIG. 23 and FIG. 24, a Container Drip Draining Device 300 comprises a pair of inner vertical supports 370 and a pair of outer vertical supports 380, with each inner vertical support 370 separated from an outer vertical support 380 by a gap 390, a support connector 310, which connects the inner vertical supports 370 to the outer vertical supports 380, and a pair of support extensions 320, which extend from the inner vertical supports 370. A support tongue 350 extends from the end of the support extensions 320 and provides support for the larger draining edge 397 of a larger draining container 398. During use, a user positions a Container Drip Draining Device 300 over the larger supporting edge 387 of a larger supporting container 388, so that the larger supporting edge 387 fits tightly into the gap 390 between the inner vertical supports 370 and the outer vertical supports 380 and the support extensions 320 protrude into the inside of the larger supporting container 388. Next, a user positions a larger draining container 398 onto the Container Drip Draining Device 300 by inserting the larger draining edge 397 of the larger draining container 398 into the support tongue 350 on the support extensions 320. When the user releases the larger draining container 398, the Container Drip Draining Device 300 stably supports the larger draining container 398 on the edge of the larger supporting container 388 at an angle sufficient to facilitate the efficient draining of the larger draining container 398 into the larger supporting container 388. Additionally, a plurality of support pegs may be used with this wireframe embodiment in order to allow for tools, such as paintbrushes, mixers, other utensils or the like, to be suspended therefrom. Furthermore, one or more support hooks 340 may be used with this wireframe embodiment in order to allow for baskets, filters or the like, to be suspended therefrom.

The construction details of the invention as shown in FIG. 20, FIG. 21, FIG. 22, FIG. 23 and FIG. 24, are that a Container Drip Draining Device 300 is a singular construction, which comprises a pair of inner vertical supports 370 and a pair of outer vertical supports 380, which each inner vertical support 370 separated from an outer vertical support 380 by a gap 390, a support connector 310, which connects the inner vertical supports 370 to the outer vertical supports 380, and a pair of support extensions 320, which extend from the inner vertical supports 370. As part of the singular construction, a support tongue 350 extends from the end of the support extensions 320 and provides support for the larger draining edge 397 of a larger draining container 398. The singular construction of a Container Drip Draining Device 300 comprises plastic, high density plastic, silicone, PVC, composite material, metal, steel, galvanized steel, stainless steel, aluminum, brass, copper, or other like material, which has sufficient strength to support a draining container, along with its contents, upon the lip of a receiving container.

Figure 25:
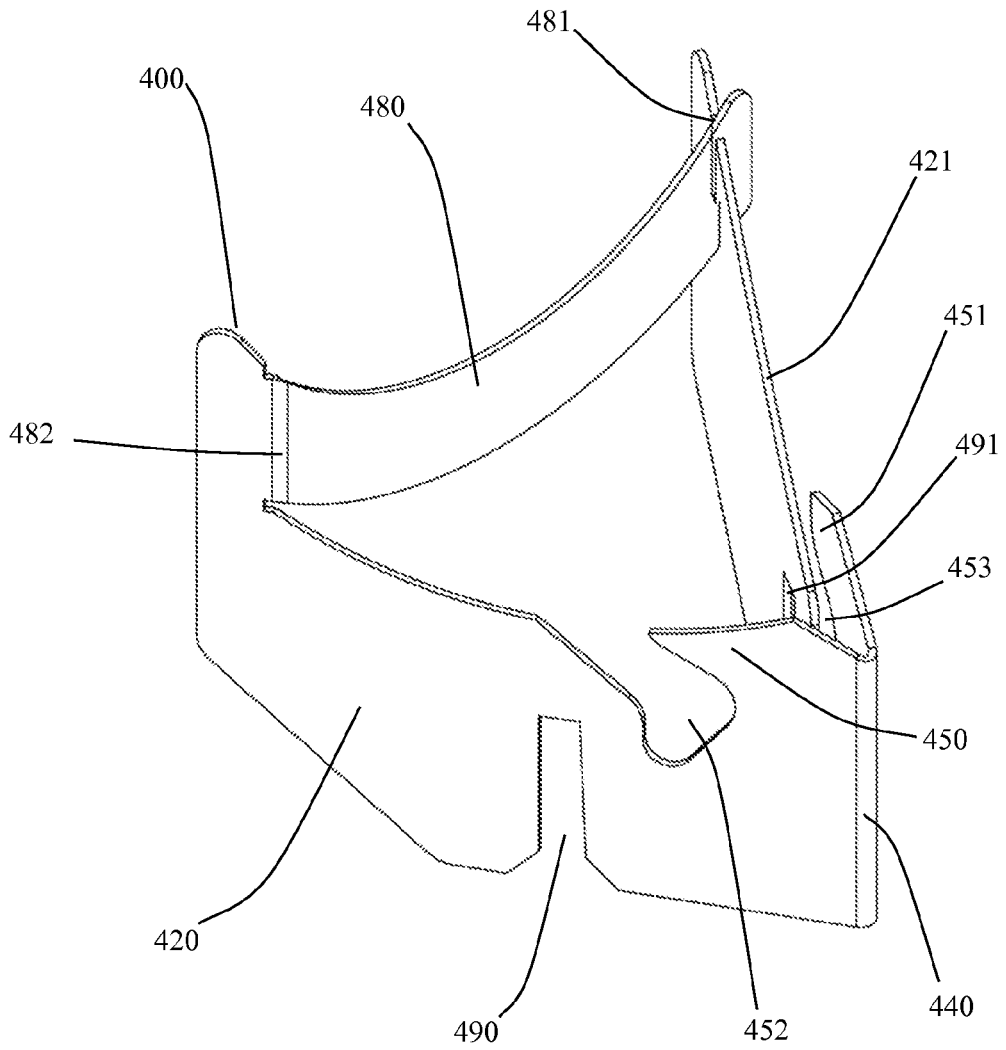
FIG. 25 is a front perspective view of an apparatus of the present invention in a folded configuration.
Figure 26:
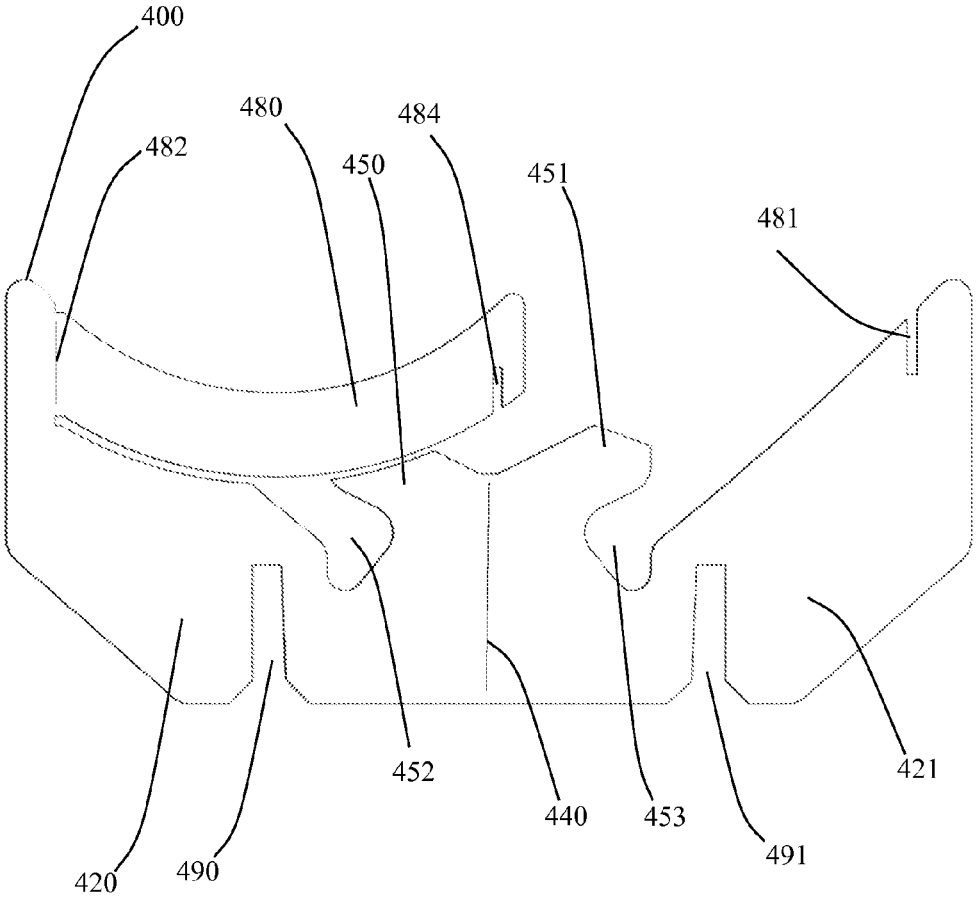
FIG. 26 is a perspective view of an apparatus of FIG. 25 in an unfolded configuration.
Figure 27:
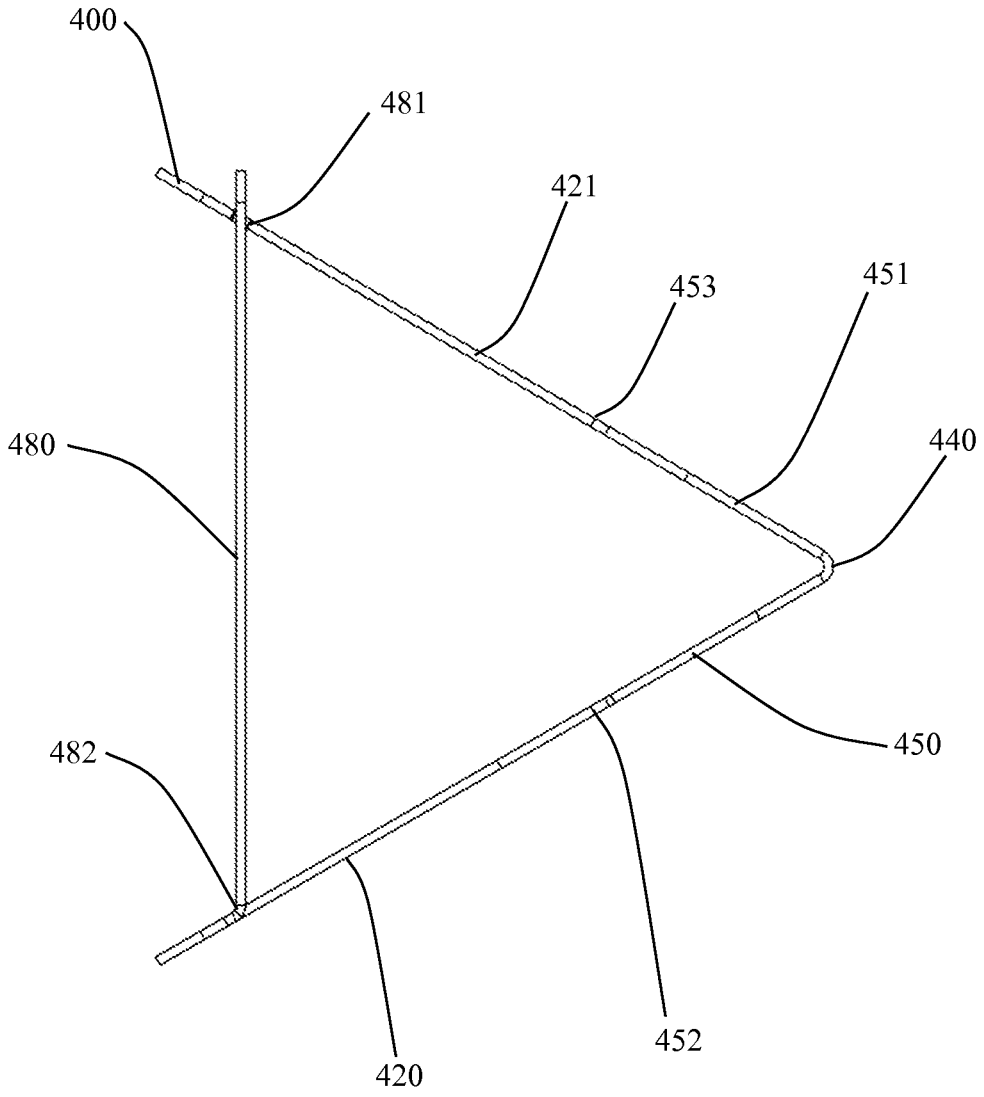
FIG. 27 is a top view of an apparatus of FIG. 25 in a folded configuration.
Figure 28:
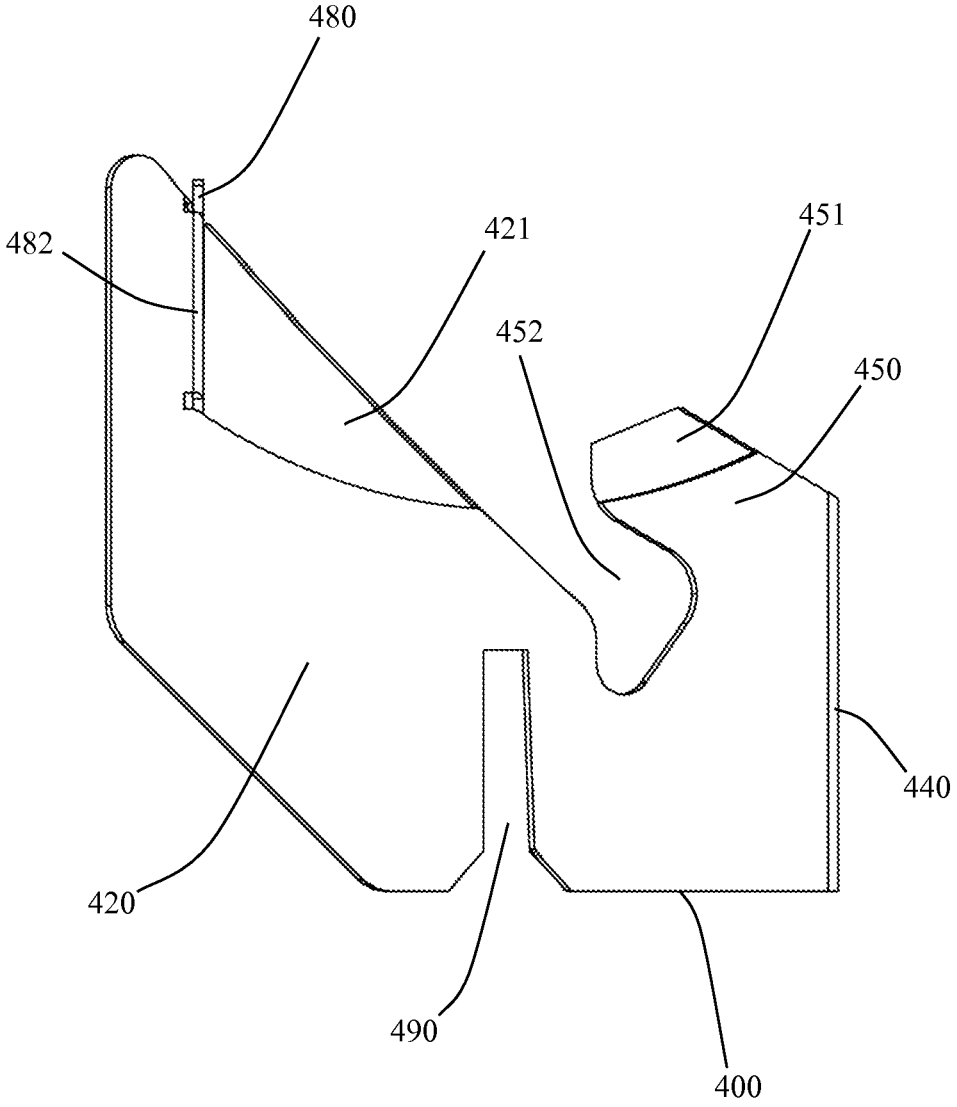
FIG. 28 is a side view of an apparatus of FIG. 25 in a folded configuration.
Figure 29:
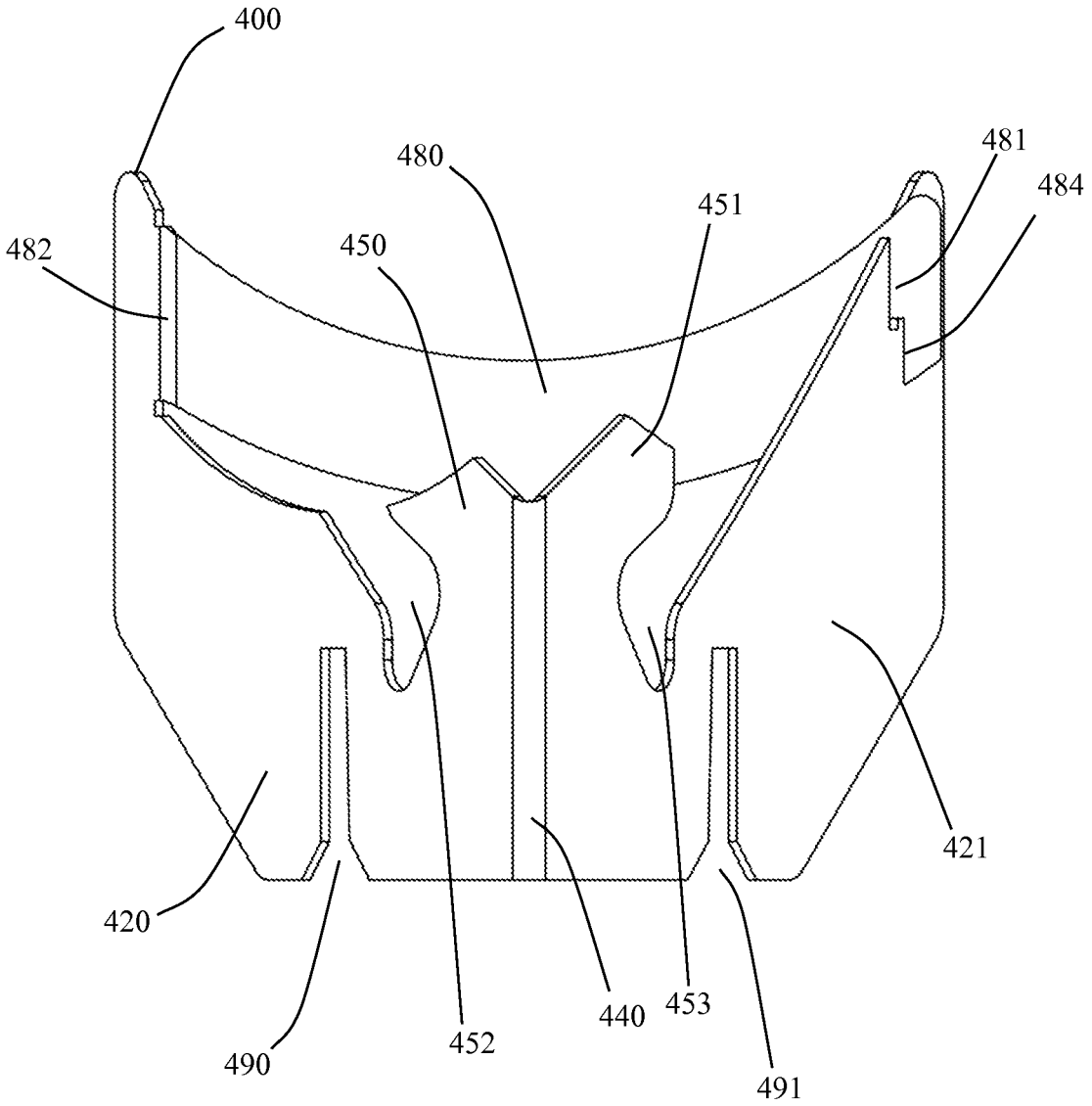
FIG. 29 is a front view of an apparatus of FIG. 25 in a folded configuration.
Figure 30:
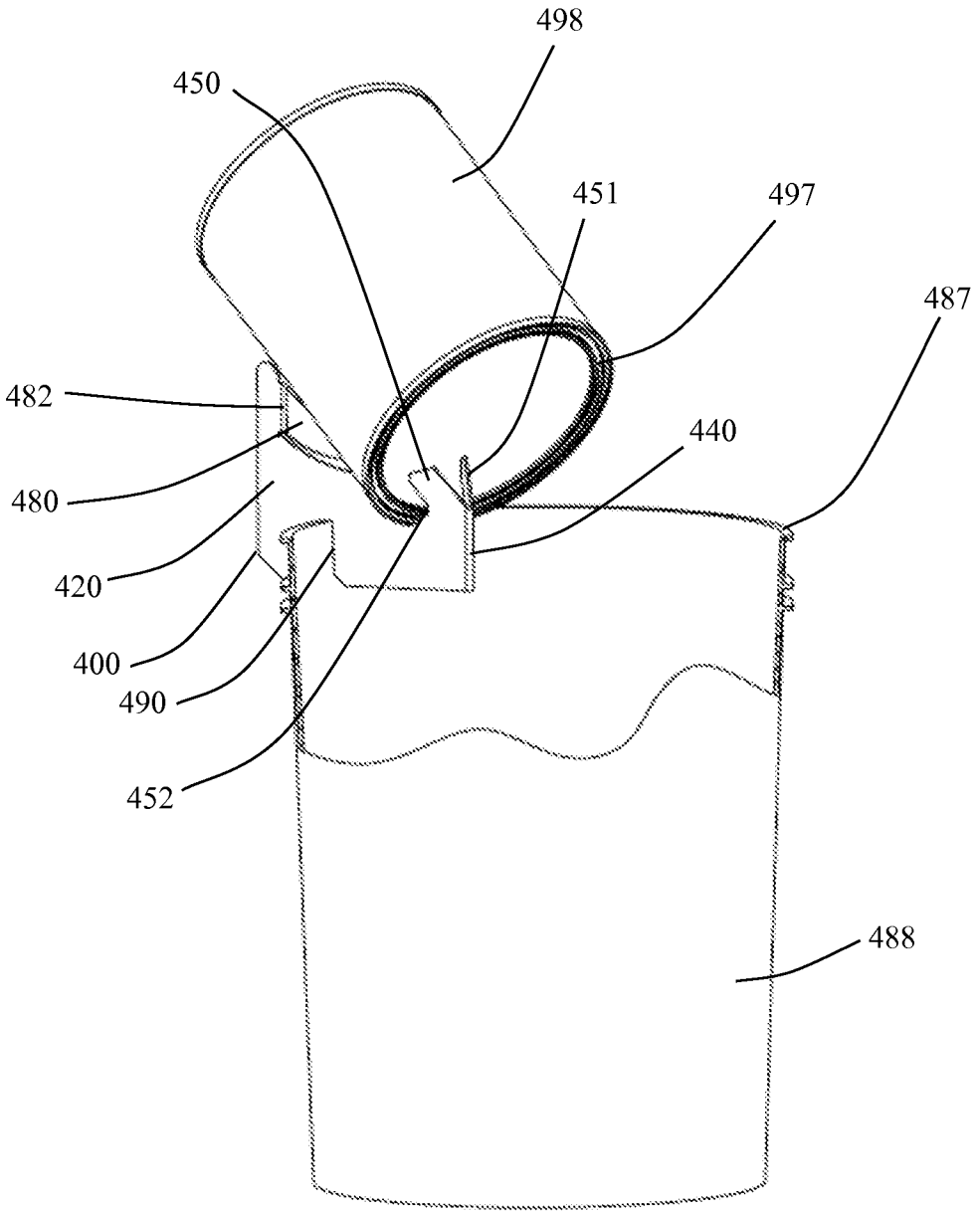
FIG. 30 is a perspective view of an apparatus of FIG. 25 in a folded configuration showing the present invention mounted on a container and supporting another container.
Figure 31:
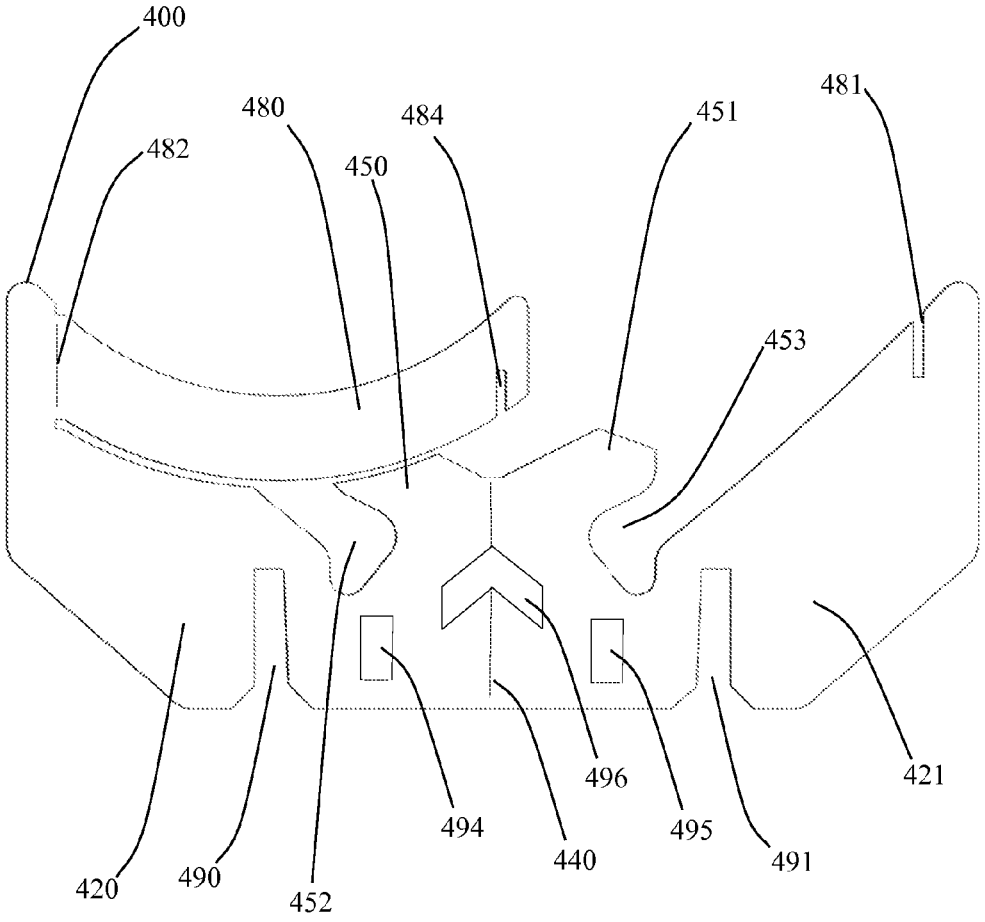
FIG. 31 is a perspective view of an apparatus of FIG. 25 in an unfolded configuration showing foldable peg folds and hook slots.

In further detail, referring now to the most preferred embodiment of the invention, in FIG. 25, FIG. 26, FIG. 27, FIG. 28, FIG. 29, FIG. 30 and FIG. 31, a Container Drip Draining Device 400 is shown. FIG. 25 demonstrates a front perspective view of a Container Drip Draining Device 400 in a folded configuration. FIG. 26 shows a perspective view of a Container Drip Draining Device 400 in an unfolded configuration. FIG. 27 depicts a top view of a Container Drip Draining Device 400 in a folded configuration. FIG. 28 shows a side view of a Container Drip Draining Device 400 in a folded configuration. FIG. 29 demonstrates a front view of a Container Drip Draining Device 400 in a folded configuration. FIG. 30 demonstrates a perspective view of a Container Drip Draining Device 400, which shows the Container Drip Draining Device 400 in a folded configuration and mounted on a supporting container 488, which is a small open-mouthed bucket, and supporting a draining container 498, which is a large open-mouthed bucket. FIG. 31 illustrates a perspective view of an apparatus of a Container Drip Draining Device 400 in an unfolded configuration showing foldable peg tabs 494, 495 and hook slots 496.

In further detail, still referring to the invention of FIG. 25, FIG. 26, FIG. 27, FIG. 28, FIG. 29, FIG. 30 and FIG. 31, a Container Drip Draining Device 400 comprises a right side panel 420 and a left side panel 421, which are connected by a first hinge 440. The right side panel 420 comprises a right supporting edge receiving slot 490, a right support tongue tab 450, a right draining edge receiving slot 452 and a foldable tab 480. The foldable tab 480 comprises a foldable tab slot 484 and is connected to the right side panel 420 by a second hinge 482. The left side panel 421 comprises a left supporting edge receiving slot 491, a left support tongue tab 451, a left draining edge receiving slot 453 and a foldable tab receiving slot 481. During use, a user folds the Container Drip Draining Device 400 along the first hinge 440, folding the foldable tab 480 inwardly between the right side panel 420 and the left side panel 421 and inserts the foldable tab slot 484 of the foldable tab 480 into the foldable tab receiving slot 481, so that the device is locked into the folded configuration. The user then positions the folded Container Drip Draining Device 400 over the supporting edge 487 of a supporting container 488, so that the supporting edge 487 fits into the right supporting edge receiving slot 490 and the left supporting edge receiving slot 491, with the first hinge 440 pointed into the center of the supporting container 488. Next, a user positions a draining container 498 onto the Container Drip Draining Device 400 by inserting the draining edge 497 of the draining container 498 into the right draining edge receiving slot 452 and the left draining edge receiving slot 453. When the user releases the draining container 498, the Container Drip Draining Device 400 stably supports the draining container 498 on the edge of the supporting container 488 at an angle sufficient to facilitate the efficient draining of the draining container 498 into the supporting container 488. Additionally, before mounting a draining container 498 onto the Container Drip Draining Device 400, a basket, filter or the like, may be suspended from the right draining edge receiving slot 452 and the left draining edge receiving slot 453. Moreover, a plurality of hook slots 496 may be added to the right side panel 420 or the left side panel 421 of Container Drip Draining Device 400 in order to enable this most preferred embodiment to suspend baskets, filters or the like. Further, a plurality of foldable peg tabs 494, 496 may be added to the right side panel 420 or the left side panel 421 of Container Drip Draining Device 400 in order to enable this most preferred embodiment to suspend tools, such as paintbrushes, mixers, other utensils or the like.

The construction details of the invention as shown of FIG. 25, FIG. 26, FIG. 27, FIG. 28, FIG. 29, FIG. 30 and FIG. 31, are that a Container Drip Draining Device 400 is a singular construction which may be cut out of a flat, foldable material. The singular construction comprises a right side panel 420 and a left side panel 421, which are connected by a first hinge 440. As part of the singular construction, the right side panel 420 comprises a right supporting edge receiving slot 490, a right support tongue tab 450, a right draining edge receiving slot 452 and a foldable tab 480, which comprises a foldable tab slot 484 and is connected to the right side panel 420 by a second hinge 482. As part of the singular construction, the left side panel 421 comprises a left supporting edge receiving slot 491, a left support tongue tab 451, a left draining edge receiving slot 453 and a foldable tab receiving slot 481. Optionally, as part of the singular construction, a plurality of hook slots 496 may be added to the right side panel 420 or the left side panel 421 of Container Drip Draining Device 400 in order to enable this most preferred embodiment to suspend baskets, filters or the like. As an additional option, as part of the singular construction, a plurality of foldable peg tabs 494, 496 may be added to the right side panel 420 or the left side panel 421 of Container Drip Draining Device 400 in order to enable this most preferred embodiment to suspend tools, such as paintbrushes, mixers, other utensils or the like. The singular construction of a Container Drip Draining Device 400 comprises any resilient foldable flat material, such as cardboard, laminate material, paper, plastic, sheet plastic, silicone, PVC, composite material, sheet metal, sheet steel, galvanized steel, stainless steel, sheet aluminum, sheet copper, or other like material, which has sufficient strength to support a draining container, along with its contents, upon the lip of a receiving container, while being flat and foldable. Additionally, instead of comprising a singular construction, the Container Drip Draining Device 400 may also be comprised of two or more flat pieces, or multiple pieces, which are folded and combined into a substantially similar arrangement. For example, the foldable tab 480, could be provided as a separate piece from the singular construction, which is fitted into the right side panel 420 and the left side panel 421 using slots.

The advantages of the present invention include, without limitation, that it provides a convenient way of draining containers without having to hold the draining container by hand. The compact, singular construction is highly portable and not as bulky as other container draining devices. Further, the Container Drip Draining Device allows for additional tools to be simultaneously drained while a container is being drained. Additionally, the Container Drip Draining Device allows for the contents of a draining container to be filtered or strained while the container is being drained. Additionally, the most preferred embodiment of the present inventions has the advantages of being easy and inexpensive to manufacture by stamping the shape out of appropriate flat material. Furthermore, the most preferred embodiment of the present inventions has the advantages of be easily and inexpensively packaged and may be efficiently stacked for transportation and distribution.

In broad embodiment, the present invention relates generally to an apparatus for draining open-top containers, such as buckets, pails or the like, into another open-top container by supporting the open-top container to be drained upon the lip of another open-top container, which receives the contents of the open-top container to be drained. More particularly, the present invention relates generally to an apparatus, which supports the open-top container to be drained in a stable manner and at an angle sufficient to drip drain the first container into the second.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiments, methods, and examples, but by all embodiments and methods that are within the scope and spirit of the invention as claimed.

What is claimed is:

1. An apparatus for draining a draining container into a supporting container, said apparatus comprising: one or more foldable flat panels; said foldable flat panels comprising a right side panel and a left side panel, which are connected by a first hinge; said right side panel comprising a right supporting edge receiving slot, a right support tongue tab, a right draining edge receiving slot and a foldable tab, which is connected to said right side panel by a second hinge, said foldable tab comprising a foldable tab slot; and said left side panel comprising a left supporting edge receiving slot, a left support tongue tab, a left draining edge receiving slot and a foldable tab receiving slot; whereby said draining container may drained into said supporting container by folding said apparatus along said first hinge, folding said foldable tab inwardly between said right side panel and said left side panel and inserting said foldable tab slot of said foldable tab into said foldable tab receiving slot, so that the device is locked into the folded configuration; positioning said apparatus over a supporting edge of said supporting container, so that said supporting edge fits into said right supporting edge receiving slot and into said left supporting edge receiving slot, with said first hinge pointed into the center of said supporting container; and by positioning said draining container onto said apparatus by inserting a draining edge of said draining container into said right draining edge receiving slot and into said left draining edge receiving slot, so that when said draining container is released, said apparatus stably supports said draining container on said supporting edge of said supporting container at an angle sufficient to facilitate the efficient drip-draining of said draining container into said supporting container.

2. An apparatus of claim 1, further comprising a plurality of foldable peg tabs, said foldable peg tab comprising a cut-out shape connected to said right side panel or said left side panel by a foldable hinge; whereby an utensil may be suspended from said foldable peg tab.

3. An apparatus of claim 1, further comprising one or more hook slots, said hook slot comprising a cut-out shape in said right side panel or in said left side panel; whereby an object may be suspended by said hook slot.

* * * * *